US009215940B2

(12) United States Patent
Hawkins

(10) Patent No.: US 9,215,940 B2
(45) Date of Patent: Dec. 22, 2015

(54) CROSS-MERCHANDISING DISPLAY FIXTURE

(71) Applicant: Target Brands, Inc., Minneapolis, MN (US)

(72) Inventor: Laura L. Hawkins, Minneapolis, MN (US)

(73) Assignee: Target Brands, Inc., Minneapolis, MN (US)

( * ) Notice: Subject to any disclaimer, the term of this patent is extended or adjusted under 35 U.S.C. 154(b) by 272 days.

(21) Appl. No.: 14/018,824

(22) Filed: Sep. 5, 2013

(65) Prior Publication Data

US 2015/0060384 A1 Mar. 5, 2015

(51) Int. Cl.

| | |
|---|---|
| ***A47F 5/10*** | (2006.01) |
| ***A47F 5/00*** | (2006.01) |
| ***A47F 5/11*** | (2006.01) |

(52) U.S. Cl.

CPC ..... *A47F 5/108* (2013.01); *A47F 5/0006* (2013.01); *A47F 5/116* (2013.01)

(58) Field of Classification Search

CPC ..... A47F 3/004; A47F 5/0006; A47F 5/0018; A47F 5/0025; A47F 5/0031; A47F 5/0043; A47F 5/108; A47F 5/11; A47F 5/16; A47F 5/116; A47F 5/118; A47F 7/00

USPC ..... 211/54.1, 57.1, 113, 162, 186, 187; D6/675.1, 675.2

See application file for complete search history.

(56) References Cited

U.S. PATENT DOCUMENTS

| | | | | |
|---|---|---|---|---|
| 1,987,567 | A | | 1/1935 | Ziemmerman |
| 2,072,193 | A | | 3/1937 | Wierzbicki |
| 2,307,993 | A | | 1/1943 | Calhoun et al. |
| 2,564,672 | A | | 8/1951 | Burr |
| 2,571,301 | A | | 10/1951 | Slanhoff |
| 2,798,618 | A | * | 7/1957 | Singer ..... 211/204 |
| 3,200,961 | A | * | 8/1965 | Kolster et al. ..... 211/186 |
| 3,468,592 | A | * | 9/1969 | Madey ..... 312/140.3 |
| 3,855,943 | A | * | 12/1974 | Larson ..... 108/28 |
| D239,346 | S | | 3/1976 | Scherzer et al. |
| 4,331,245 | A | * | 5/1982 | Schell ..... 211/45 |
| 4,655,352 | A | | 4/1987 | Noyes et al. |
| D319,934 | S | * | 9/1991 | Terrell et al. ..... D6/681.2 |
| 5,048,701 | A | | 9/1991 | Simpson |

(Continued)

OTHER PUBLICATIONS

Pending U.S. Appl. No. 29/466,199, filed Sep. 5, 2013, entitled Display Shelf, 6 pages.

(Continued)

*Primary Examiner* — Joshua Rodden

(74) *Attorney, Agent, or Firm* — Leanne Taveggia Farrell; Westman, Champlin & Koehler, P.A.

(57) ABSTRACT

A display fixture includes a shelf display including a main body having a front side and a backside, a plurality of shelves coupled to the front side of the main body and adapted to support merchandise and a back support attached to the backside of the main body and extending from the backside of the main body. The display fixture also includes a rack display including a frame having at least one substantially vertical member located on a first side of the rack display, at least one substantially vertical member located on a second side of the rack display and at least one arm coupled to the frame to support hanging merchandise. A plurality of fasteners secure the at least one substantially vertical member to the back support of the shelf display.

13 Claims, 20 Drawing Sheets

(56) References Cited

U.S. PATENT DOCUMENTS

| | | | | |
|---|---|---|---|---|
| D327,788 | S * | 7/1992 | Allen | D6/675.1 |
| 5,944,219 | A | 8/1999 | Emoff et al. | |
| 6,029,833 | A * | 2/2000 | Yeh | 211/189 |
| 6,105,796 | A | 8/2000 | Buchanan et al. | |
| D435,182 | S | 12/2000 | Mason | |
| 6,267,263 | B1 | 7/2001 | Emoff et al. | |
| D451,300 | S | 12/2001 | Stafford et al. | |
| 6,364,099 | B2 | 4/2002 | Emoff et al. | |
| 6,405,880 | B1 * | 6/2002 | Webb | 211/59.2 |
| 6,467,856 | B1 * | 10/2002 | Chang et al. | 312/108 |
| D474,350 | S * | 5/2003 | Sardis | D6/681.1 |
| 6,959,824 | B1 * | 11/2005 | Alperson | 211/193 |
| D520,265 | S | 5/2006 | Sparkowski | |
| D566,989 | S | 4/2008 | Mason | |
| 7,387,213 | B1 * | 6/2008 | Smalley | 211/106 |
| D584,078 | S * | 1/2009 | Weigand | D6/672 |
| D591,531 | S | 5/2009 | Sparkowski | |
| 7,644,527 | B2 * | 1/2010 | Clark et al. | 40/610 |
| 7,810,658 | B2 | 10/2010 | Clark et al. | |
| D632,509 | S | 2/2011 | Perc | |
| 7,900,385 | B2 * | 3/2011 | Clark et al. | 40/538 |
| D638,639 | S | 5/2011 | Ma | |
| 7,946,435 | B2 | 5/2011 | Clark et al. | |
| 7,988,000 | B2 | 8/2011 | Clark et al. | |
| D657,591 | S | 4/2012 | Sanchez | |
| 8,191,720 | B2 | 6/2012 | Clark et al. | |
| D685,206 | S | 7/2013 | Hawkins | |
| D687,183 | S | 7/2013 | Davis et al. | |
| D689,306 | S | 9/2013 | Fishman et al. | |
| D689,715 | S | 9/2013 | Wong | |
| D690,968 | S | 10/2013 | Hawkins | |
| 8,919,579 | B2 * | 12/2014 | Weigand et al. | 211/55 |
| 2005/0230338 | A1 * | 10/2005 | Farinola et al. | 211/186 |
| 2006/0118502 | A1 | 6/2006 | Polvere et al. | |
| 2009/0026202 | A1 | 1/2009 | Osmann | |
| 2009/0250422 | A1 * | 10/2009 | Clark et al. | 211/189 |
| 2010/0006529 | A1 | 1/2010 | Groff et al. | |
| 2010/0326939 | A1 * | 12/2010 | Clark et al. | 211/153 |
| 2014/0305893 | A1 * | 10/2014 | Beach | 211/71.01 |

OTHER PUBLICATIONS

Office Action from Canadian Patent Application No. 153,738, mailed Apr. 15, 2014 (1 page).

* cited by examiner

CROSS-MERCHANDISING DISPLAY FIXTURE

BACKGROUND

In retail stores, cross-merchandising includes the practice of positioning, stocking or displaying product from different departments together on a single display fixture. This practice may generate add-on sales as well as be an effective way of improving the overall customer experience.

The discussion above is merely provided for general background information and is not intended to be used as an aid in determining the scope of the claimed subject matter.

SUMMARY

A display fixture includes a permanent portion that supports merchandise and includes a frame having first end pieces, second end pieces and at least one cross member connecting the first end pieces to the second end pieces. The first and second end pieces and the at least one cross member support the permanent portion in an upright configuration and the at least one cross member includes a first end that protrudes outwardly from the first end pieces and a second end that protrudes outwardly from the second end pieces. The display fixture further includes a temporary portion including a front that supports merchandise and a back that mates with the permanent portion. A plurality of fasteners attach the first end pieces or the second end pieces to the permanent portion.

A display fixture includes a shelf display including a main body having a front side and a backside, a plurality of shelves coupled to the front side of the main body and adapted to support merchandise and a back support attached to the backside of the main body and extending from the backside of the main body. The display fixture also includes a rack display including a frame having at least one substantially vertical member located on a first side of the rack display, at least one substantially vertical member located on a second side of the rack display and at least one arm coupled to the frame to support hanging merchandise. A plurality of fasteners secure the at least one substantially vertical member to the back support of the shelf display.

A method of assembling a display fixture includes obtaining a rack display made of metal that includes a frame having at least one substantially vertical member located on a first side of the rack display and at least one substantially vertical member located on a second side of the rack display. The rack display further includes at least one arm coupled to the frame to support hanging merchandise. A shelf display is erected that is made of sheet material that includes a front having a plurality of shelves that support merchandise and a back having a back support. The back support of the shelf display is fastened to the at least one substantially vertical member located on the first side of the rack display or the at least one substantially vertical member located on the second side of the rack display with a plurality of fasteners.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the background.

DETAILED DESCRIPTION

The cross-merchandising display fixture described below can be located in a retail store for displaying products from different departments. The cross-merchandising display fixture includes two portions: a temporary portion or shelf display and a permanent portion or rack display. The temporary portion or shelf display is shipped to a store flat or in a substantially planar configuration and is lightweight, inexpensive and recyclable. For example, components of the temporary portion or shelf display can be made of a sheet material, such as corrugated cardboard. The permanent portion or rack display generally already exists at the store as a standard piece of display fixture equipment and is made of a heavy-duty material, such as metal. For example, the permanent portion or rack display can be a quad rack fixture. A quad rack fixture is a type of permanent fixture that has a frame and four extendable or telescopic arms adapted to support clothes, hangers and etc. To assemble the cross-merchandising display fixture, the temporary portion or shelf display is attached to the permanent portion or rack display. Together, the temporary portion or shelf display and the permanent portion or rack display displays coordinating products that might not otherwise be displayed in the same area of a retail store.

Figure 1:
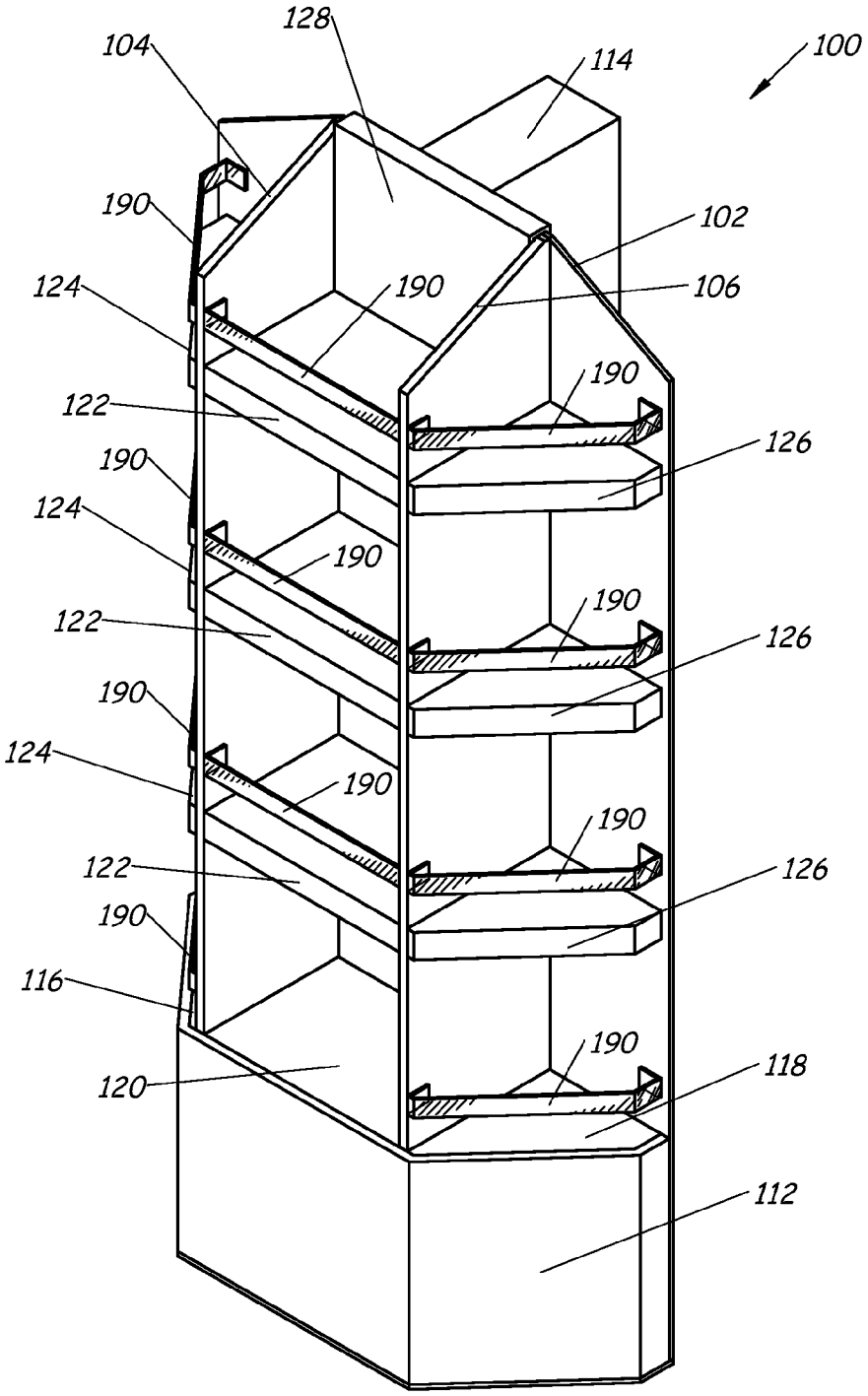
FIG. 1 is a perspective view of a temporary portion of a cross-merchandising display fixture according to one embodiment.
Figure 2:
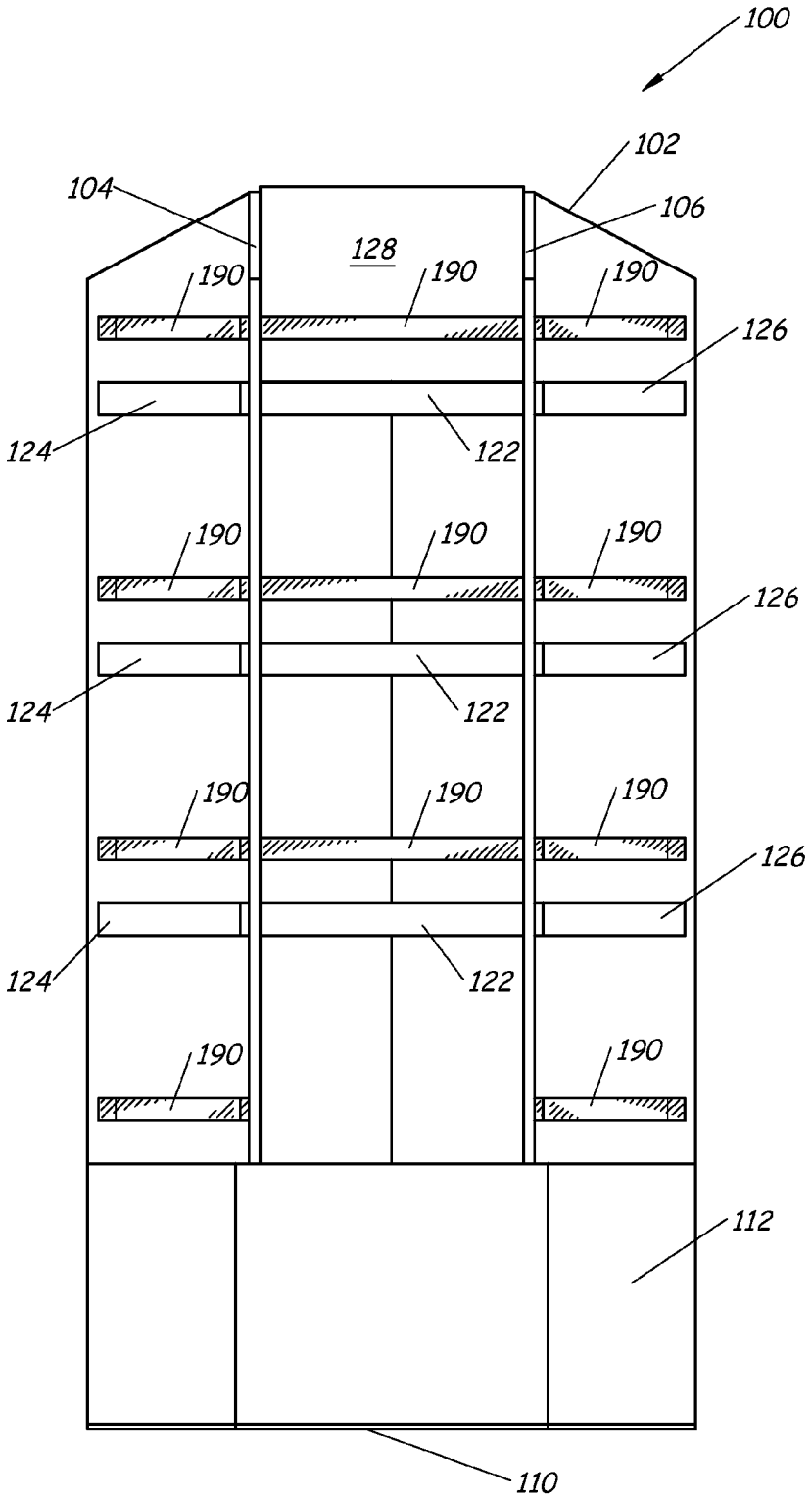
FIG. 2 is a front view of the temporary portion illustrated in FIG. 1.
Figure 3:
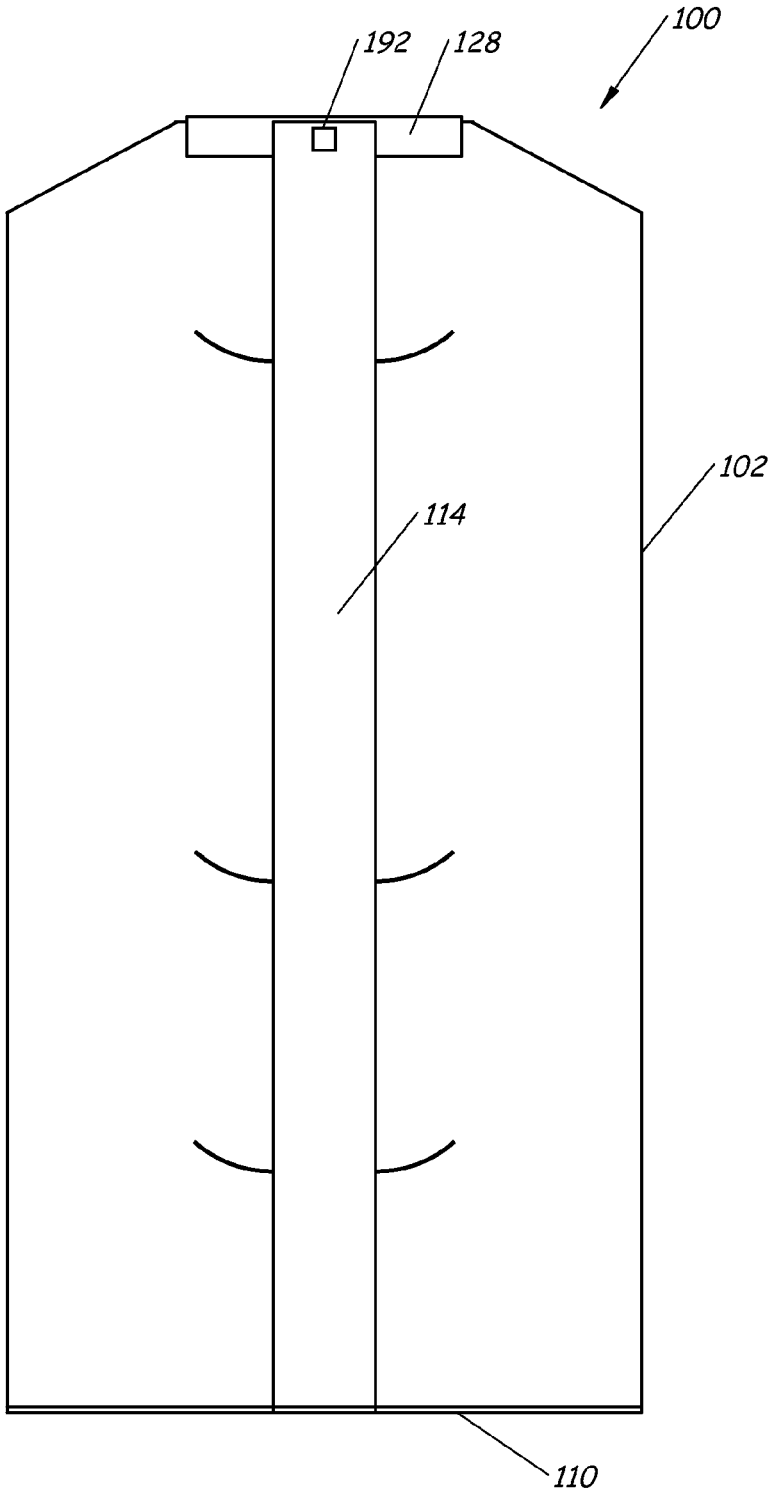
FIG. 3 is a back view of the temporary portion illustrated in FIG. 1.
Figure 4:
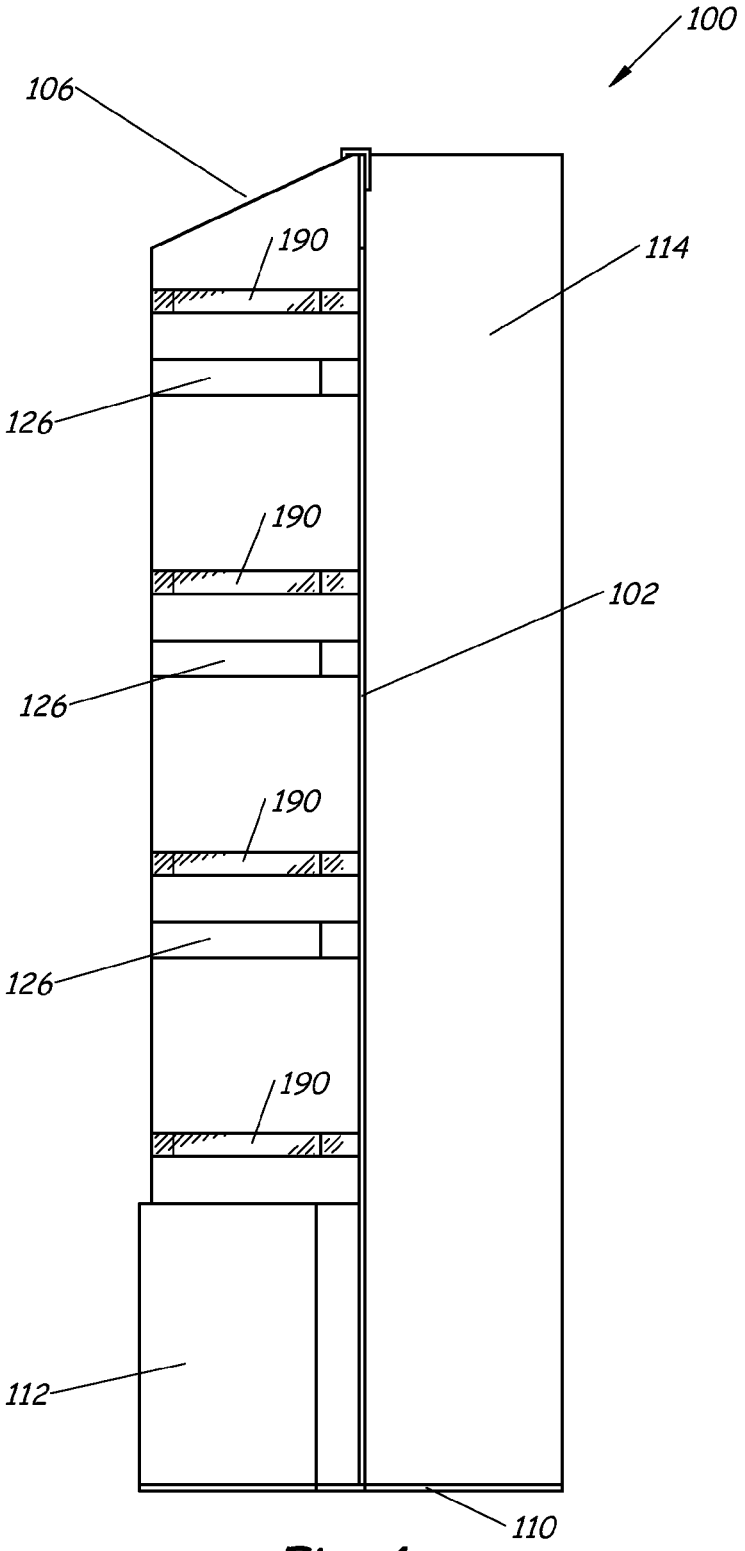
FIG. 4 is a side view of the temporary portion illustrated in FIG. 1.
Figure 5:
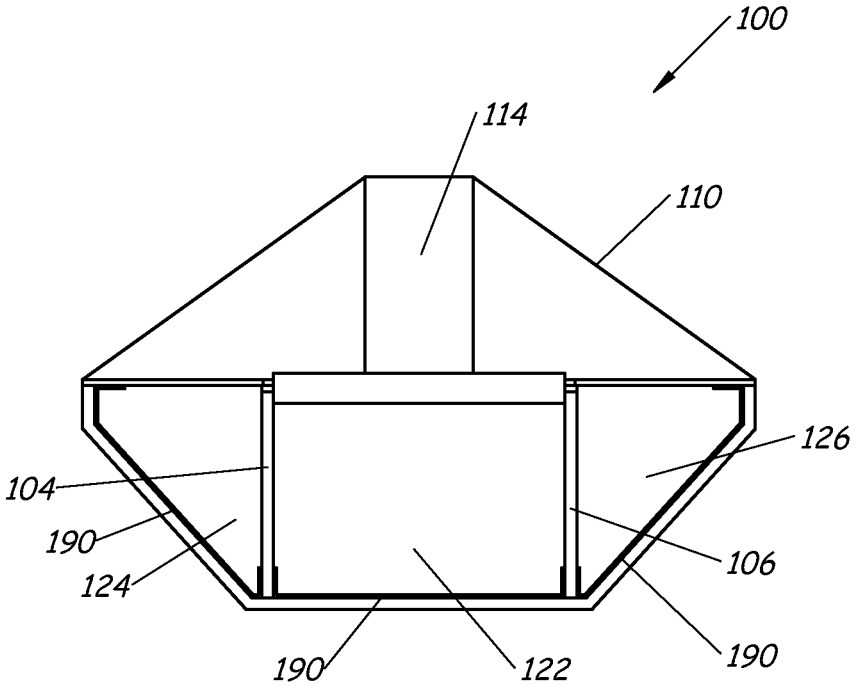
FIG. 5 is a top view of the temporary portion illustrated in FIG. 1.

FIG. 1 is a perspective view of a temporary portion or shelf display 100 of a cross-merchandising display fixture according to one embodiment. FIG. 2 is a front view of portion 100 illustrated in FIG. 1. FIG. 3 is a back view of portion 100 illustrated in FIG. 1. FIG. 4 is a side view of portion 100 illustrated in FIG. 1, the opposing side being a mirror image. FIG. 5 is a top view of portion 100 illustrated in FIG. 1, the bottom being unornamented. Although several elements are shown in the figures, it contemplated by the inventors that one or more of the elements depicted in the figures may be removed while still providing an innovative shelf display. In one embodiment, portion 100 includes a front that supports merchandise on shelves and a back that mates with a permanent portion of a cross-merchandising display fixture. On the front, portion 100 can display shelf-type products. For example, the front of portion 100 can display bottles of lotion, such as bottles of sun tanning lotion, sun blocking lotion, after-sun lotions, gels, sprays and the like.

Figure 9:
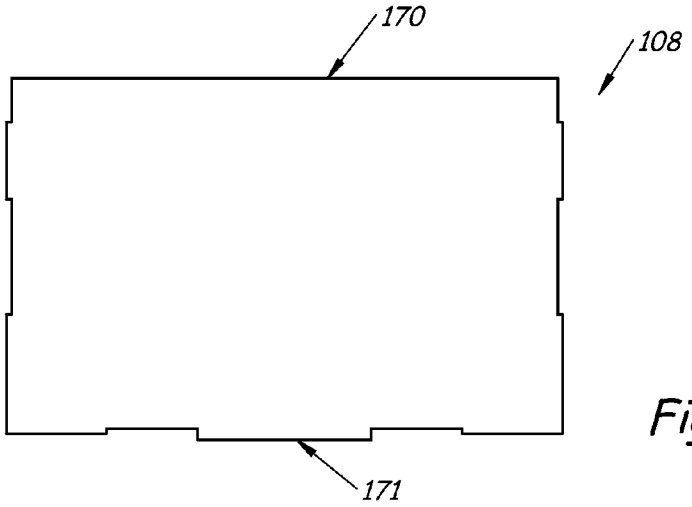
FIG. 9 is a plan view of a center shelf insert of the temporary portion illustrated in FIG. 1 in a substantially planar configuration.
Figure 10:
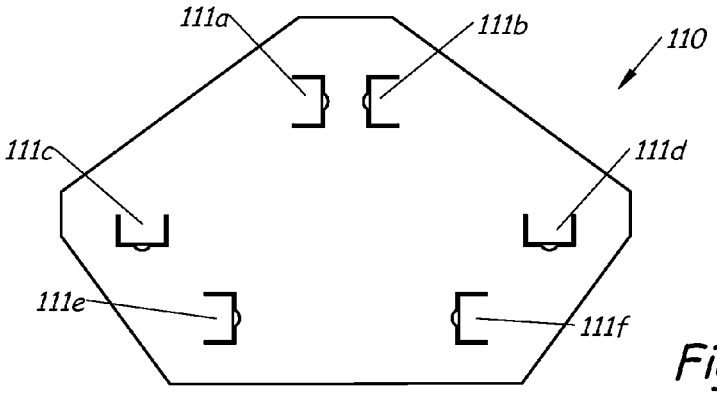
FIG. 10 is a plan view of a bottom body of the temporary portion illustrated in FIG. 1 in a substantially planar configuration.
Figure 11:
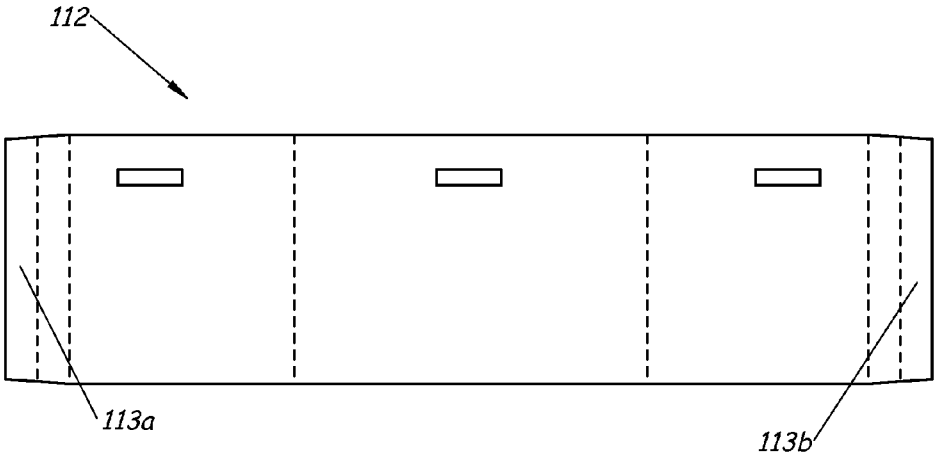
FIG. 11 is a plan view of a bottom wrap of the temporary portion illustrated in FIG. 1 in a substantially planar configuration.
Figure 12:
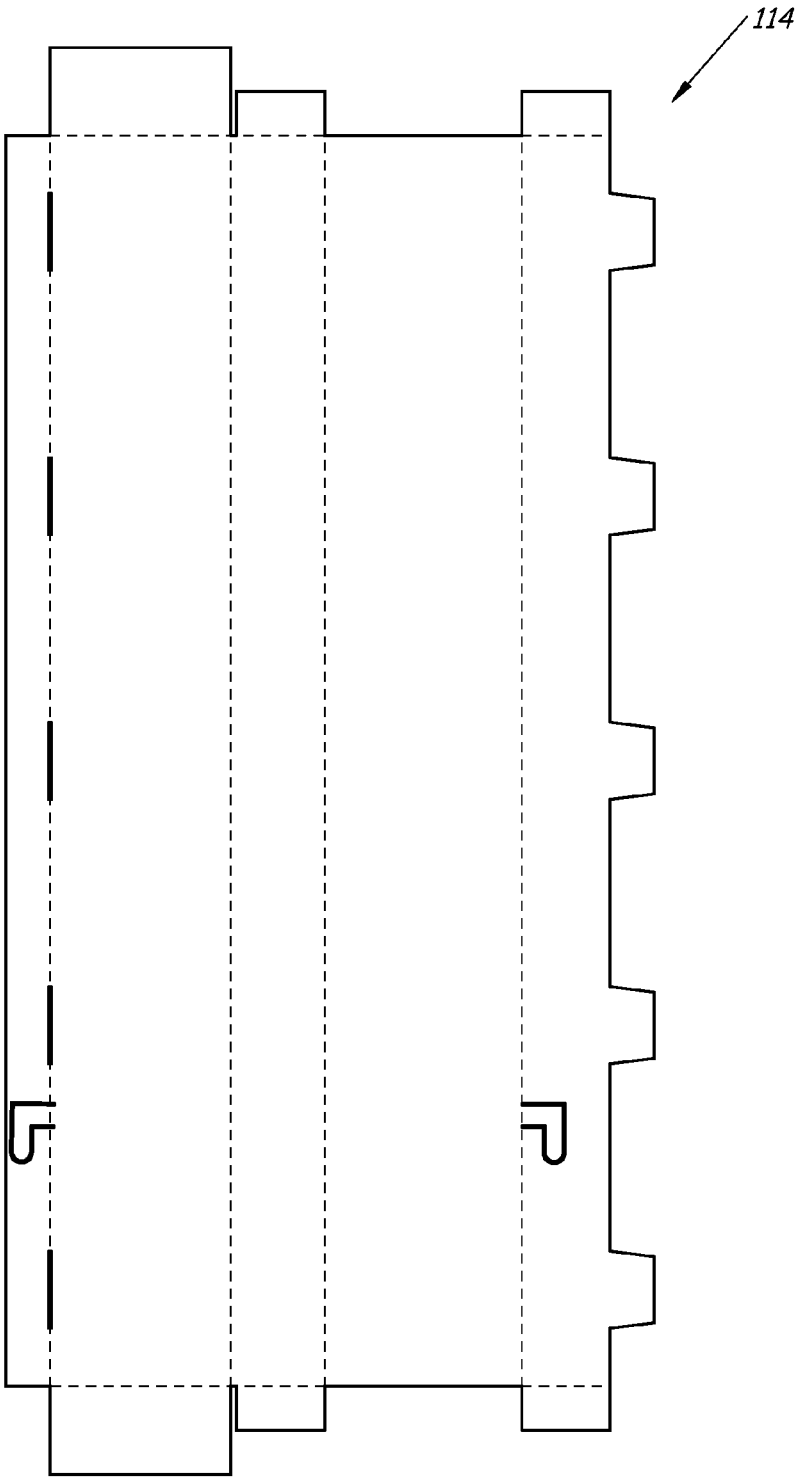
FIG. 12 is a plan front view of a back support of the temporary portion illustrated in FIG. 1 in a substantially planar configuration.
Figure 13:
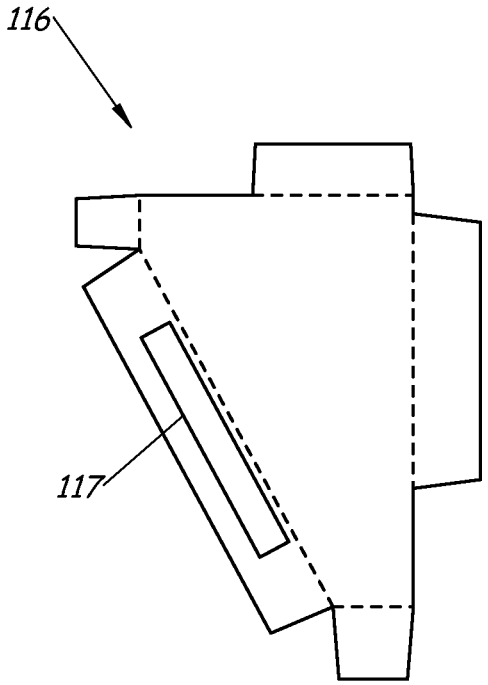
FIG. 13 is a plan view of a left bottom shelf of the temporary portion illustrated in FIG. 1 in a substantially planar configuration.
Figure 14:
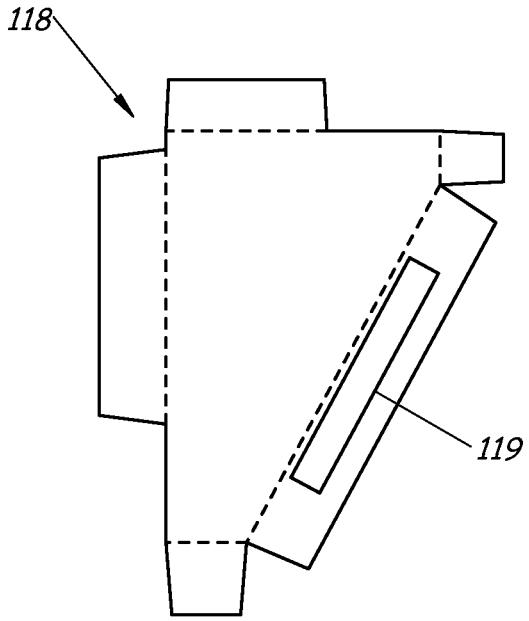
FIG. 14 is a plan view of a right bottom shelf of the temporary portion illustrated in FIG. 1 in a substantially planar configuration.
Figure 15:
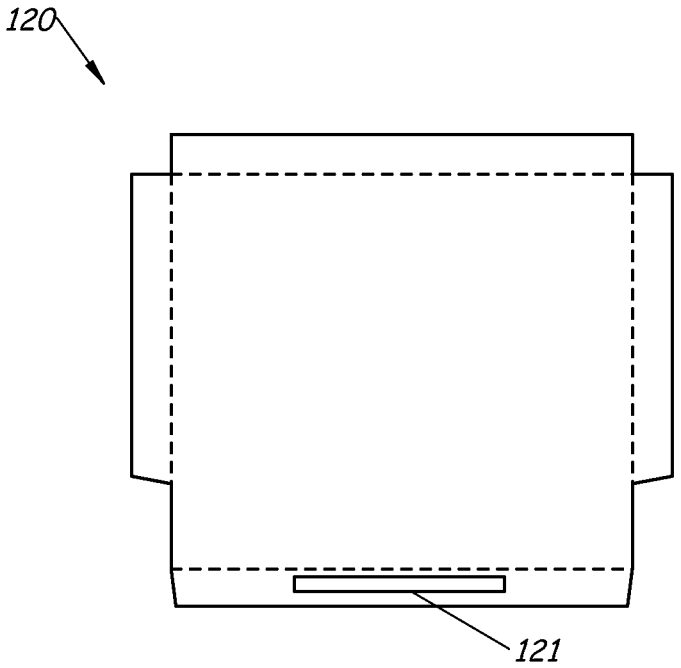
FIG. 15 is a plan view of a center bottom shelf of the temporary portion illustrated in FIG. 1 in a substantially planar configuration.
Figure 16:
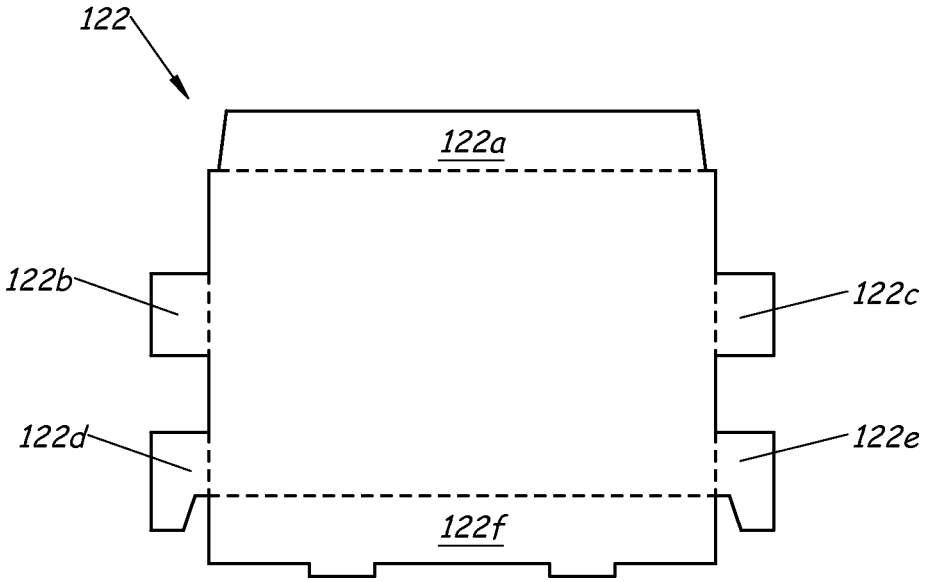
FIG. 16 is a plan view of a center shelf of the temporary portion illustrated in FIG. 1 in a substantially planar configuration.
Figure 17:
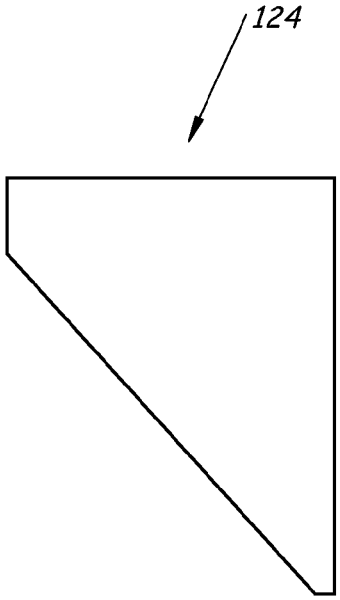
FIG. 17 is a perspective view of a left shelf of the temporary portion illustrated in FIG. 1 in an erected configuration.
Figure 18:
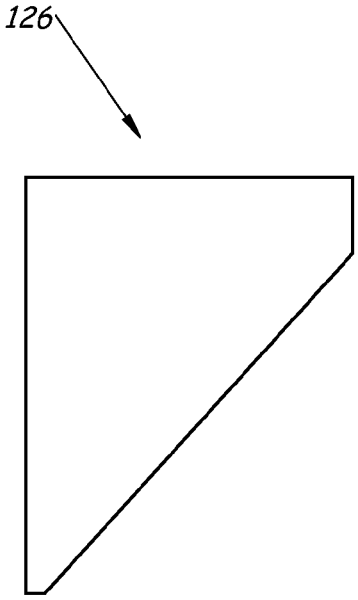
FIG. 18 is a perspective view of a right shelf of the temporary portion illustrated in FIG. 1 in an erected configuration.
Figure 19:
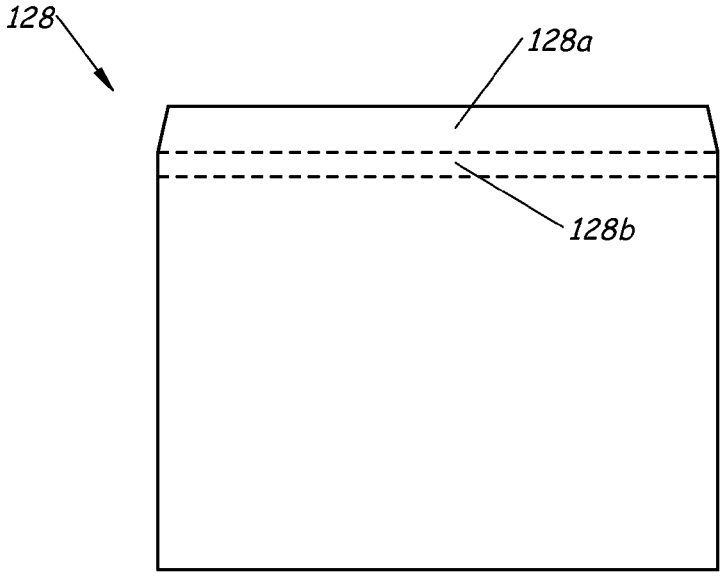
FIG. 19 is a plan view of a sign holder of the temporary portion illustrated in FIG. 1 in a substantially planar configuration.

Each component of portion 100 is shipped to a retail store flat or in a substantially planar configuration and is lightweight, inexpensive, and recyclable. For example, FIG. 6 illustrates a plan back view of a main body or main upright component 102 in a substantially planar configuration, FIG. 7 illustrates a plan view of a left body or left upright component 104 in a substantially planar configuration, FIG. 8 illustrates a plan view of a right body or right upright component 106 in a substantially planar configuration, FIG. 9 illustrates a plan view of a center shelf insert 108 in a substantially planar configuration, FIG. 10 illustrates a plan view of a bottom body 110 in a substantially planar configuration, FIG. 11 illustrates a plan view of a bottom wrap 112 in a substantially planar configuration, FIG. 12 illustrates a plan view of a back support 114 in a substantially planar configuration, FIG. 13 illustrates a plan view of a left bottom shelf 116 in a substantially planar configuration, FIG. 14 illustrates a plan view of a right bottom shelf 118 in a substantially planar configuration, FIG. 15 illustrates a plan view of a center bottom shelf 120 in a substantially planar configuration, FIG. 16 illustrates a plan view of a center shelf 122 in a substantially planar configuration, FIG. 17 is a top view of a left shelf 124 in an erected configuration, FIG. 18 is a top view of a right shelf 126 in an erected configuration and FIG. 19 is a plan view of a sign holder 128.

Main body or upright component 102, left body or left upright component 104, right body or right upright component 106, center shelf insert 108, bottom body 110, bottom wrap 112, back support 114, left bottom shelf 116, right bottom shelf 118, center bottom shelf 120, center shelf 122 and sign holder 128 are all parts of portion 100 that are shipped flat to a retail store for later assembly. A plurality of left shelves 124 and a plurality of right shelves 126 can be shipped to a retail store in an erected configuration as illustrated in FIGS. 17 and 18 because these components are already compact and thin. In light of the substantially planar configurations and the thin erected configurations, in one embodiment, portion 100 can be easily deconstructed for disposal. For example, components 102, 104, 106, 108, 110, 112, 114, 116, 118, 120, 122, 124, 126 and 128 can be made of a sheet material, such as corrugated cardboard. In FIGS. 6-19, which illustrate planar or erected configurations of components, all solid lines represent free edges while all dashed lines represent scores or folds.

Figure 6:
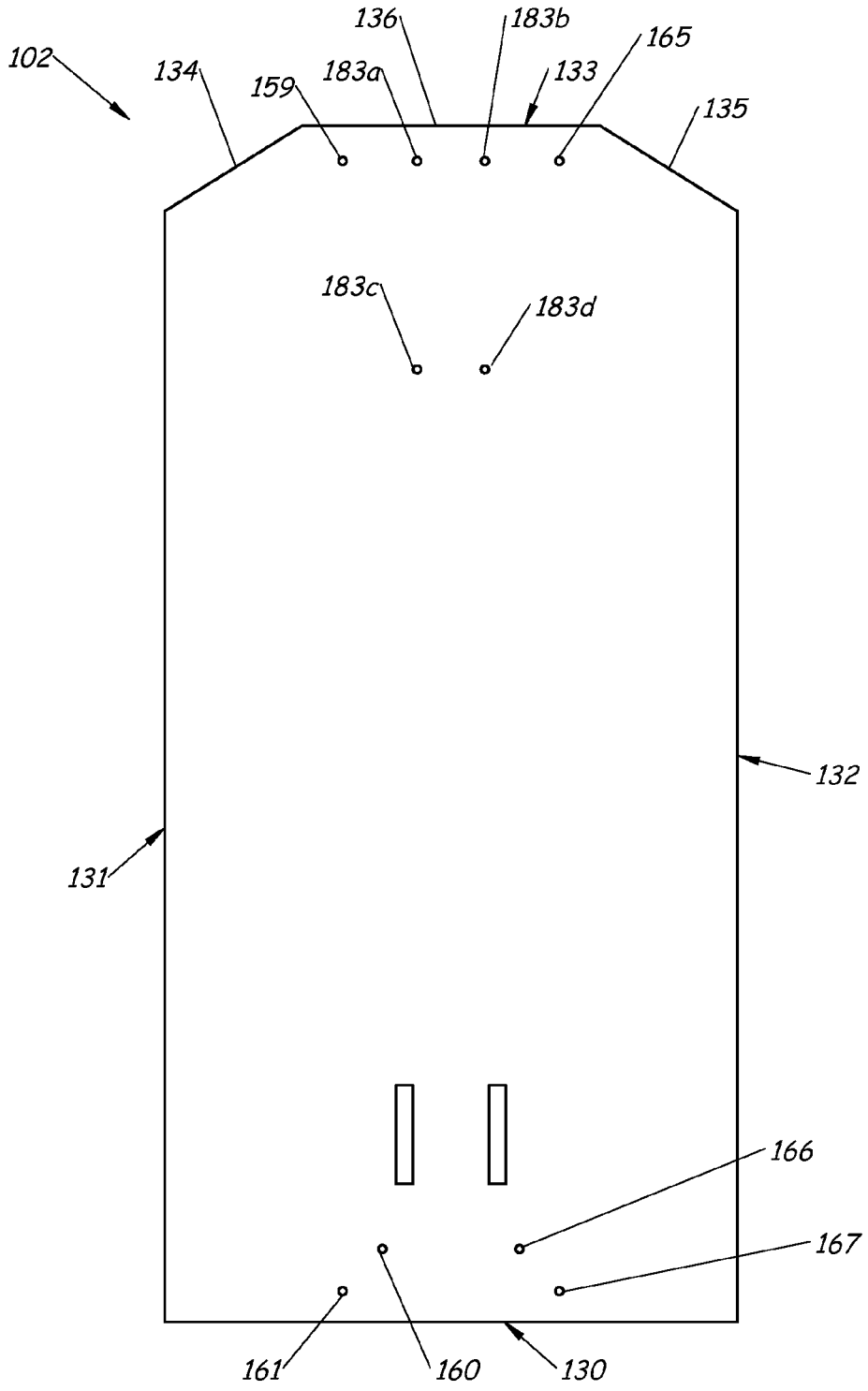
FIG. 6 is a plan view of a backside of a main body of the temporary portion illustrated in FIG. 1 in a substantially planar configuration.

As illustrated in FIG. 6 and in one embodiment, main body 102 includes a single panel having a bottom free edge 130, left and right side free edges 131 and 132 and a top free edge 133. While left and right side free edges 131 and 132 substantially perpendicularly intersect with bottom free edge 130, top free edge 133 includes two tapered segments 134 and 135, which intersect with right and left side free edges 131 and 132 respectfully, that are connected to each other by a straight segment 136 that is substantially perpendicular to right and left side free edges 131 and 132. Main body 102 includes a front side, a backside (illustrated in FIG. 6) and an arrangement of openings on front side and backside, which will be discussed in detail below, for coupling other components of portion 100 to main body 102. Main body 102 divides the front of temporary portion 100 from the back of temporary portion 100. More specifically, the front side of main body will support shelves for holding shelf-type merchandise and the backside of main body 102 will couple to a back support that will mate with a permanent portion of the cross-merchandising display fixture.

Figure 7:
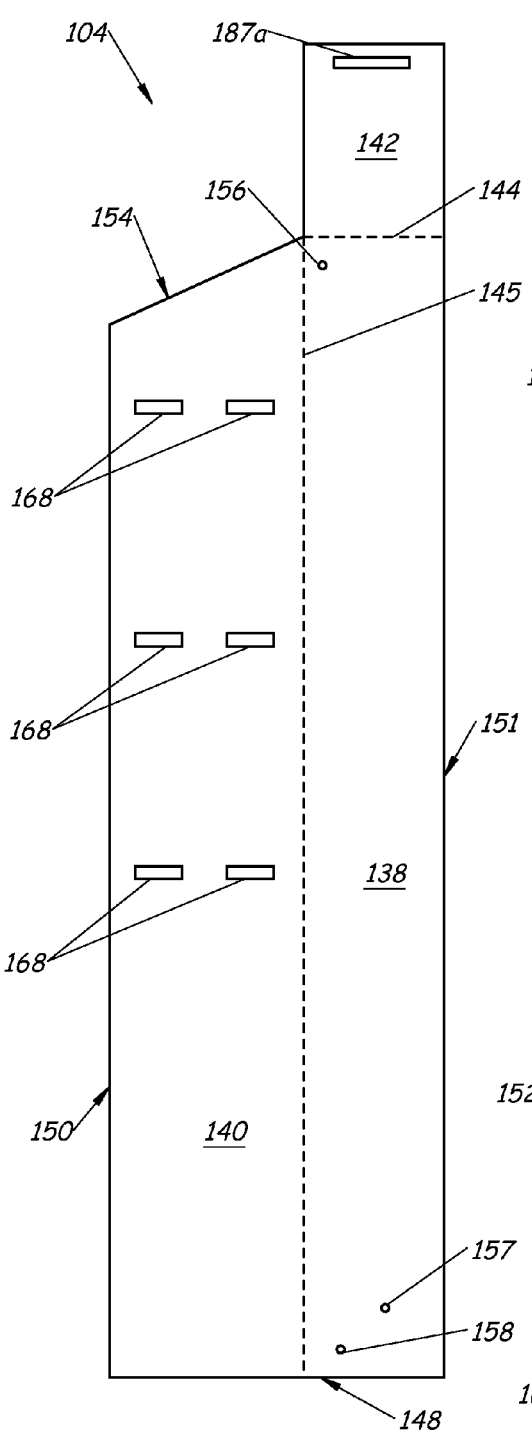
FIG. 7 is a plan view of a front side of a left body of the temporary portion illustrated in FIG. 1 in a substantially planar configuration.
Figure 8:
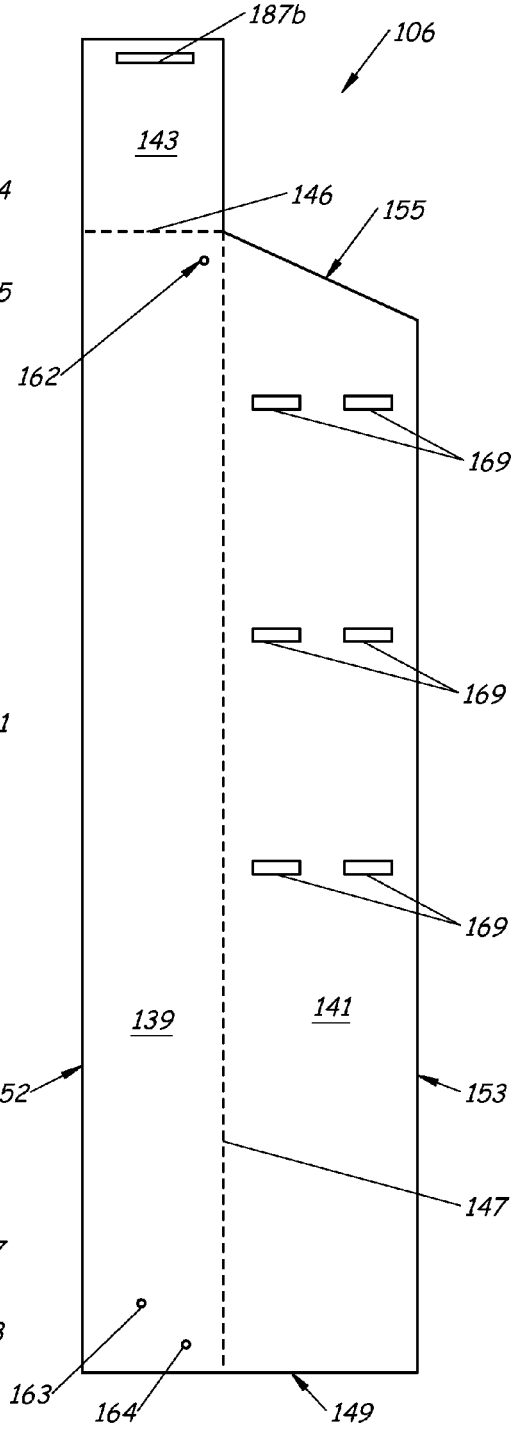
FIG. 8 is a plan view of a front side of a right body of the temporary portion illustrated in FIG. 1 in a substantially planar configuration.

As illustrated in FIGS. 7 and 8 and in one embodiment, each of left body 104 and right body 106 includes a back panel 138 and 139, a side panel 140 and 141 and a top panel 142 and 143, respectfully. In regards to left body 104, top panel 142 is coupled to back panel 138 along a top score 144 and side panel 140 is coupled to back panel 138 along a side score 145. In regards to right body 106, top panel 143 is coupled to back panel 139 along a top score 146 and side panel 141 is coupled to back panel 139 along a side score 147. Each of left and right bodies 104 and 106 includes a bottom free edge 148 and 149. Bottom free edge 148 extends along the bottom of back panel 138 the bottom of side panel 140. Bottom free edge 149 extends along the bottom of back panel 139 and the bottom of side panel 141. Each of left and right bodies 104 and 106 also include left free edges 150 and 152 and right free edges 151 and 153. Left free edge 150 of left body 104 extends along a left side of side panel 140 and right free edge 151 of left body 104 extends along a right side of back panel 138. Left free edge 152 of right body 106 extends along a left side of back panel 139 and right free edge 153 of right body 106 extends along a right side of side panel 141. As discussed, the top of back panels 138 and 139 are coupled to top panels 142 and 143, respectfully, however, the top of side panels 140 and 141 include a tapered free edge 154 and 155 that substantially matches the tapered segments 134 and 135 of top free edge 133 of main body 102. Right body 104 and left body 106 include an arrangement of holes and adhesives, which will be discussed in detail below, and will couple other components of portion 100 to right body 104 and left body 106.

Figure 20:
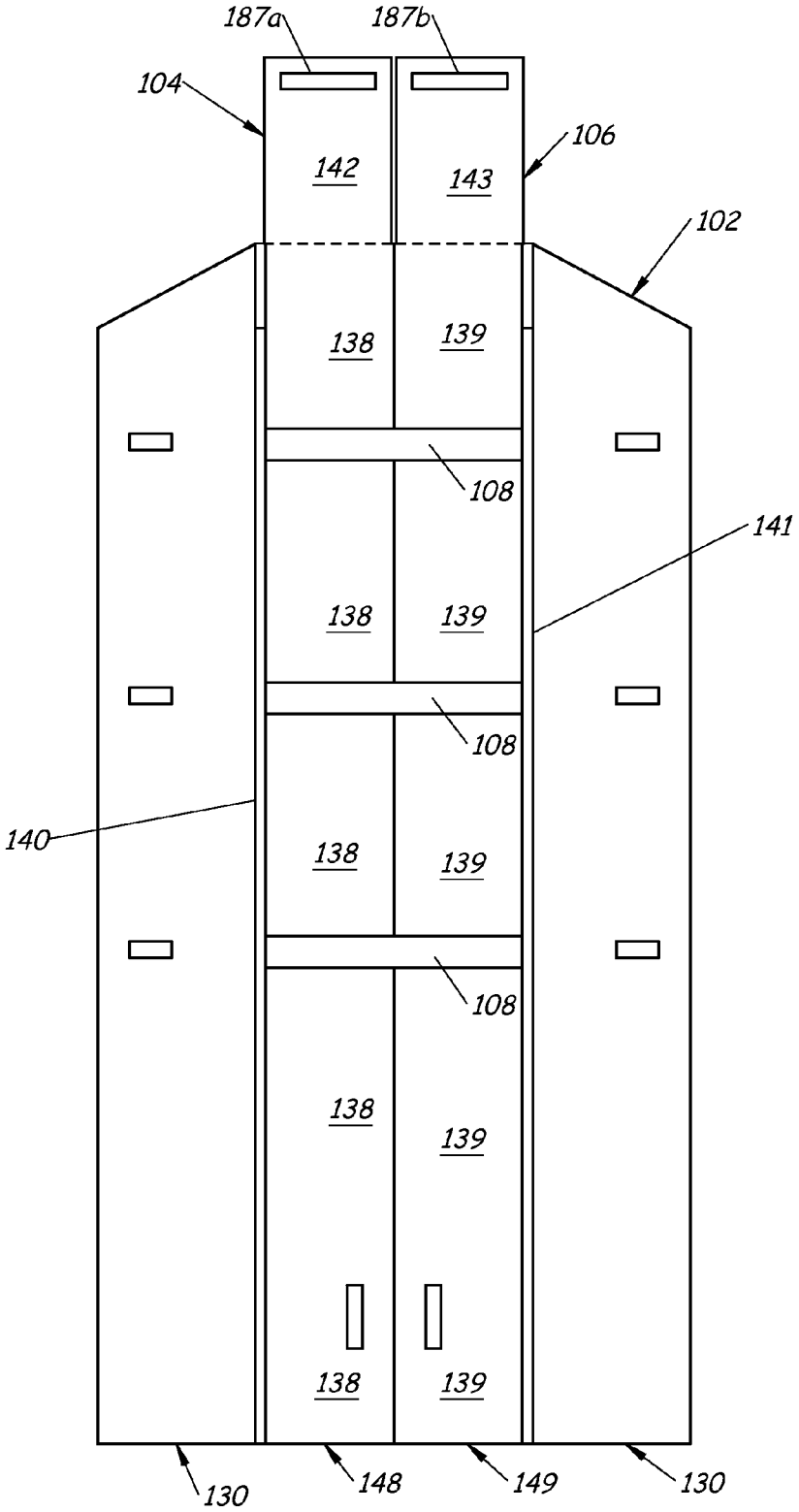
FIG. 20 is a front view of the main body in FIG. 5, the left body in FIG. 6, the right body in FIG. 7 and a plurality of center shelf inserts in FIG. 8 in an assembled configuration.

FIG. 20 is a front view of main body 102 (FIG. 6), left body 104 (FIG. 7), right body 106 (FIG. 8) and a plurality of center shelf inserts 108 (FIG. 9) in an assembled configuration. To achieve the assembled configuration illustrated in FIG. 20, left body 104 is placed on top of main body 102 and openings 156, 157 and 158 in left body 104 are aligned with openings 159, 160 and 161 in main body 102 and fastened together using fasteners or clips (not illustrated). Right body 106 is placed on top of main body 102 and openings 162, 163 and 164 in right body 106 are aligned with openings 165, 166 and 167 in main body 102 and fastened together using fasteners or clips.

Side panel 140 of left body 104 is folded up such that side panel 140 is substantially perpendicular to the single panel of main body 102 and to back panel 138 of left body 104. Side panel 141 of right body 106 is folded up such that side panel 141 of right body 106 is substantially perpendicular to the single panel of main body 102 and to back panel 139 of right body 106. In this way the plurality of clips 168 located on side panel 140 of left body 104 and the plurality of clips 169 located on side panel 141 of right body 106 face inwardly to receive the plurality of center shelf inserts 108. As illustrated in FIG. 20 and in one embodiment, clips 168 and 169 receive three center shelf inserts 108. However, left body 104 and right body 106 can include any number of clips for receiving any number of center shelf inserts 108. Each center shelf insert 108 includes a front edge 170 and a back edge 171 (see FIG. 9). Back edge 171 abuts back panels 138 and 139 after each center shelf insert is inserted into clips 168 and 169. Upon center shelf inserts 108 being inserted into clips 168 and 169, main body 102, left body 104, right body 106 and the plurality of center shelf inserts 108 are assembled and the assembly can be stood up on its bottom edges 130, 148 and 149.

Figure 21:
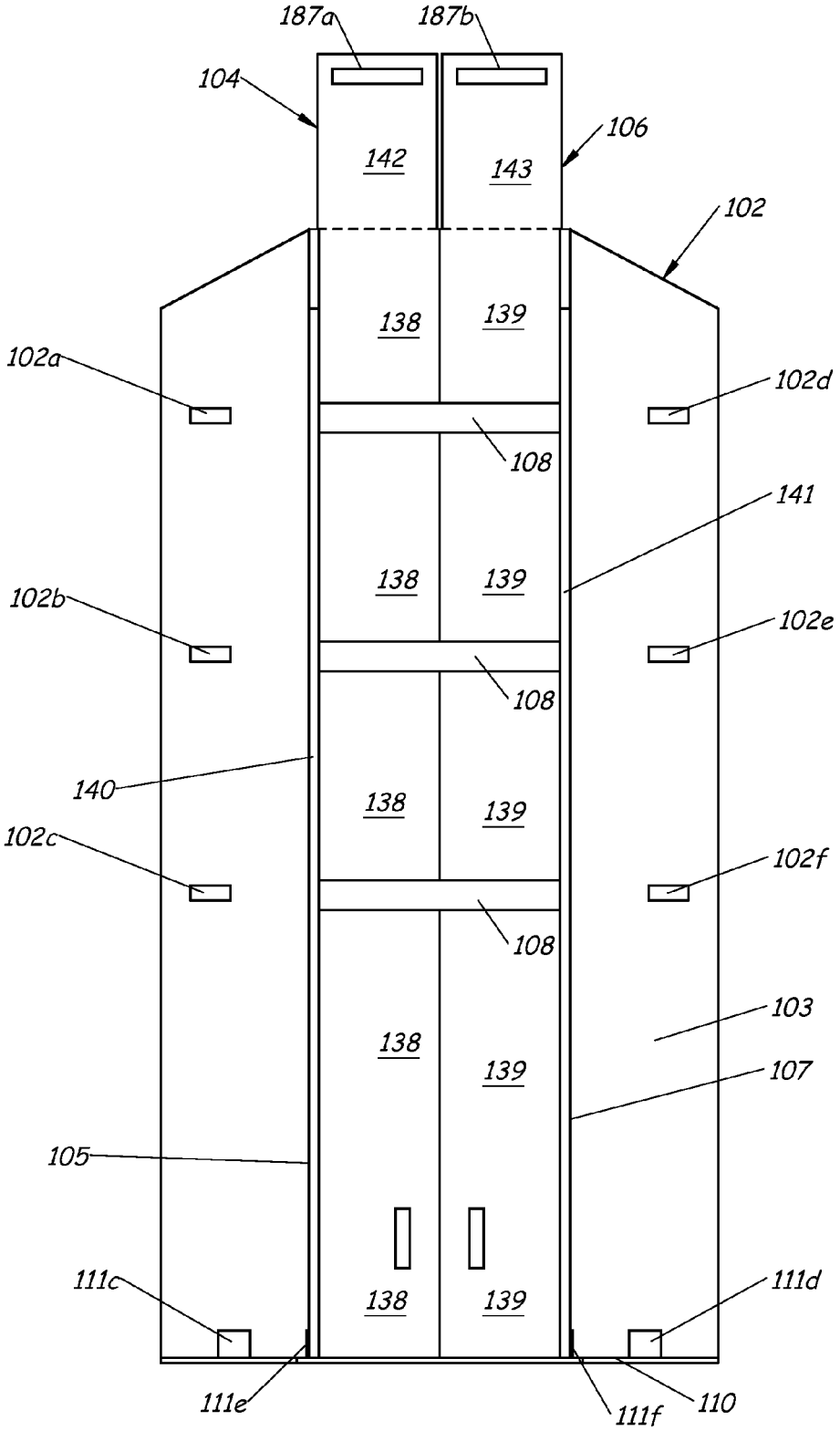
FIG. 21 is a front view of the bottom body in FIG. 9 assembled to the assembly illustrated in FIG. 20.

FIG. 21 is a front view of bottom body 110 (FIG. 10) assembled to the assembly illustrated in FIG. 20. To achieve the assembled configuration illustrated in FIG. 21, all tabs 111*a*, 111*b*, 111*c*, 111*d*, 111*e* and 111*f* are folded up from their substantially planar configuration illustrated in FIG. 10. The assembly illustrated in FIG. 20 is placed on top of bottom body 110 such that bottom edge 130 of main body 102 is aligned with tabs 111*c* and 111*d*, bottom edge 148 along side panel 140 is aligned with tab 111*e* and bottom edge 149 along side panel 141 is aligned with tab 111*f*. As illustrated in FIG. 21, tabs 111*c* and 111*d* are fastened to a front surface 103 (FIG. 21) of main body 102 with a clip or fastener (not illustrated), tab 111*e* is fastened to outer surface 105 of side panel 140 of left body 104 with a clip or fastener (not illustrated) and tab 111*f* is fastened to outer surface 107 of side panel 141 of right body 106 with a clip or fastener (not illustrated).

Figure 22:
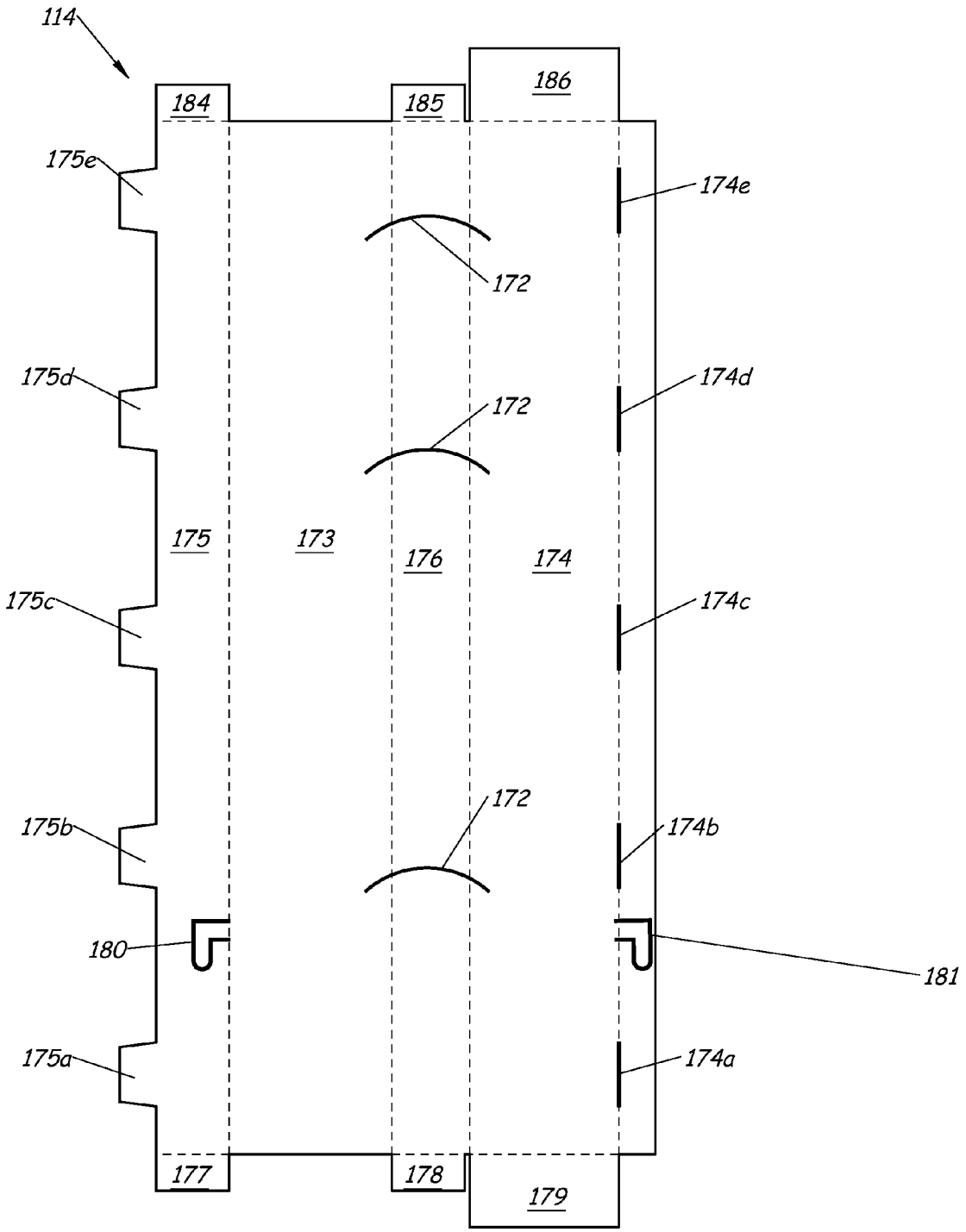
FIG. 22 is a plan back view of the back support in FIG. 12 in a substantially planar configuration and illustrating the placement of fasteners.

FIG. 22 is a plan back view of back support 114 (FIG. 12) in a substantially planar configuration and illustrates the placement of fasteners for fastening temporary portion 100 of a cross-merchandising display fixture to a permanent portion of a cross-merchandising display fixture. In particular, the fasteners 172 illustrated in FIG. 22 are cable ties or zip ties. However, other types of fasteners can be used for fastening portion 100 to a permanent portion. Cable ties or zip ties were originally designed to bunch together and/or organize cables and wires, but can be used for a variety of other applications. Commonly, cable ties or zip ties are made of nylon and include an integral gear rack and a ratchet mechanism having an open case located on a head of the cable tie. Once the end opposite the head end of the cable tie is pulled through the open case and past the ratchet mechanism, the cable is prevented from being pulled back and thereby makes the resulting loop only capable of being pulled tighter and not loosened. In FIG. 22 and in one embodiment, there are three cable ties with the head end and the end opposite the head end of each inserted through holes in back support 114. However, any number of cable ties and corresponding hole sets can be used for fastening portion 100 of a display fixture to a permanent portion of a display fixture.

Back support 114 includes a front panel 175, a back panel 176 and left and right side panels 173 and 174 coupling front panel 175 to back panel 176, bottom panel 179 and a top panel 186. From its substantially planar configuration, further assembly is needed to configure back support 114 into the usable configuration illustrated in FIGS. 1 and 3-5. In the usable configuration, front panel, back panel 176, left and right side panels 173 and 174, bottom panel 179 and top panel 186 define a hollow interior. In particular, left and right side panels 173 and 174 are lifted up relative to back panel 176 and front panel 175 and a right flap 174' are folded over. Lock tabs 175*a*, 175*b*, 175*c*, 175*d* and 175*e* are inserted into corresponding slots 174*a*, 174*b*, 174*c*, 174*d* and 174*e* until front panel 175 is flush with right side panel 174. Bottom flaps 177 and 178 are folded in and bottom panel 179 is folded over and inserted into the body of back support 114 until flush with left side panel 173, front panel 175 and back panel 176. Back support 114 also includes a pair of front tabs 180 and 181. Front tab 180 is connected to where front panel 175 couples to left panel 173 and front tab 181 is connected to where right panel 174 couples to right flap 174'.

Figure 23:
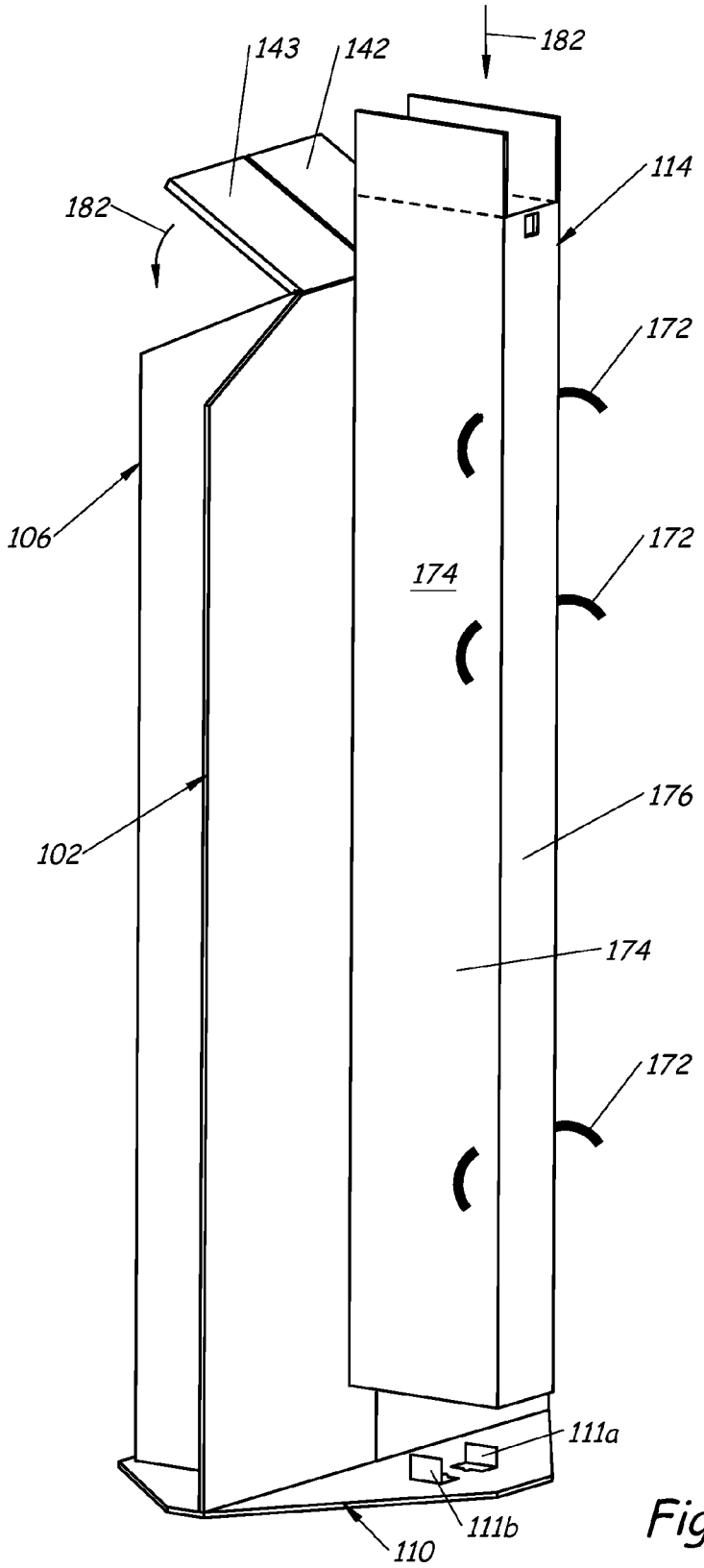
FIG. 23 is a back perspective view of the back support in FIGS. 12 and 22 being assembled to the assembly illustrated in FIG. 21.

FIG. 23 is a back perspective view of back support 114 (FIGS. 12 and 22) being assembled to the assembly illustrated in FIG. 21 or being attached to the backside of main body 102. Although not specifically illustrated in FIG. 23, front tabs 180 and 181 of back support 114 are inserted into corresponding slots in the back of main body 102. Back support 114 is pressed down as indicated by arrow 182 until bottom panel 179 (FIG. 22) of back support 114 is flush with bottom body 110 and bottom panel 179 is aligned with tabs 111*a* and 111*b* on bottom body 110. As illustrated, tabs 111*a* and 111*b* are fastened to the outer surface of left panel 173 and right panel 174 with clips or fasteners (not illustrated). In addition, fasteners or clips (not illustrated) are inserted through holes 183*a*, 183*b*, 183*c* and 183*d* (FIG. 6) in main body 102 to further fasten back support 114 to main body 102. After back support 114 is fastened to main body 102, top flaps 184 and 185 (FIG. 22) are folded in and top panel 186 (FIG. 22) is folded up and inserted into the body of back support 114 until flush with left side panel 173, front panel 175 and back panel 176. Still further, adhesive backers 187*a* and 187*b* (FIGS. 7 and 8) are removed from top panel 142 of left body 104 and top panel 143 of right panel 106 and top panels 142 and 143 are folded down as illustrated by arrow 182' to adhesively couple to front surface 103 of main body 102.

Figure 24:
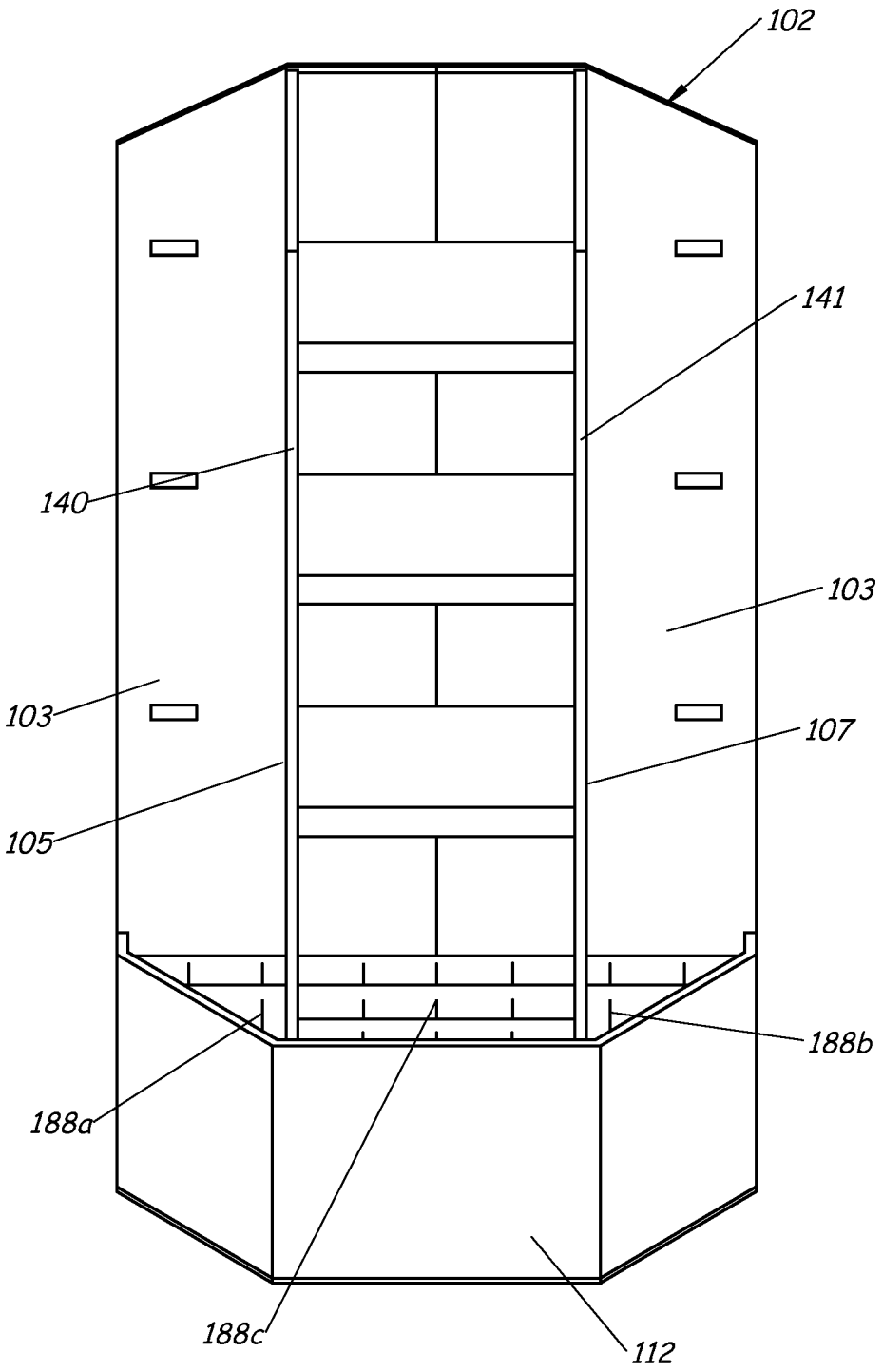
FIG. 24 is a front perspective view of the bottom wrap in FIG. 11 and support partitions assembled to the assembly illustrated in FIG. 21.

FIG. 24 is a front perspective view of bottom wrap 112 (FIG. 11) and support partitions assembled to the assembly illustrated in FIG. 23. To achieve the assembled configuration illustrated in FIG. 24, the scores illustrated in FIG. 11 should be creased and tabs (not illustrated) located on the center section of the back side of bottom wrap 112 should be folded up to fasten to the interior surface of side panel 140 of left body 104 and to fasten to the interior surface side panel 141 of right body 106. To further fasten bottom wrap 112 to the assembly illustrated in FIG. 23, side flaps 113*a* and 113*b* (FIG. 11) are fastened to front surface 103 of main body 102.

The support partitions illustrated in FIG. 24 include left and right bottom partitions 188*a* and 188*b* as well as a center bottom partition 188*c*. Left bottom partition 188*a* is inserted into the assembly illustrated in FIG. 24 between the backside of assembled bottom wrap 112, the exterior surface 105 of side panel 140 and front surface 103 of main body 102. Right bottom partition 188*b* is inserted into the assembly illustrated in FIG. 24 between the backside of assembled bottom wrap 112, the exterior surface 107 of side panel 141 of right body 106 and front surface 103 of main body 102. Center bottom partition 188*c* is inserted into the assembly illustrated in FIG. 24 between the backside of assembled bottom wrap 112, front surface 103 of main body 102, an interior surface (opposite exterior surface 105) of side panel 140 of left body 104 and an interior surface (opposite exterior surface 107) of side panel 141 of right body 106. All partitions 188*a*, 188*b* and 188*c* are pressed down until the bottom edges of the partitions contact bottom body 110.

Figure 25:
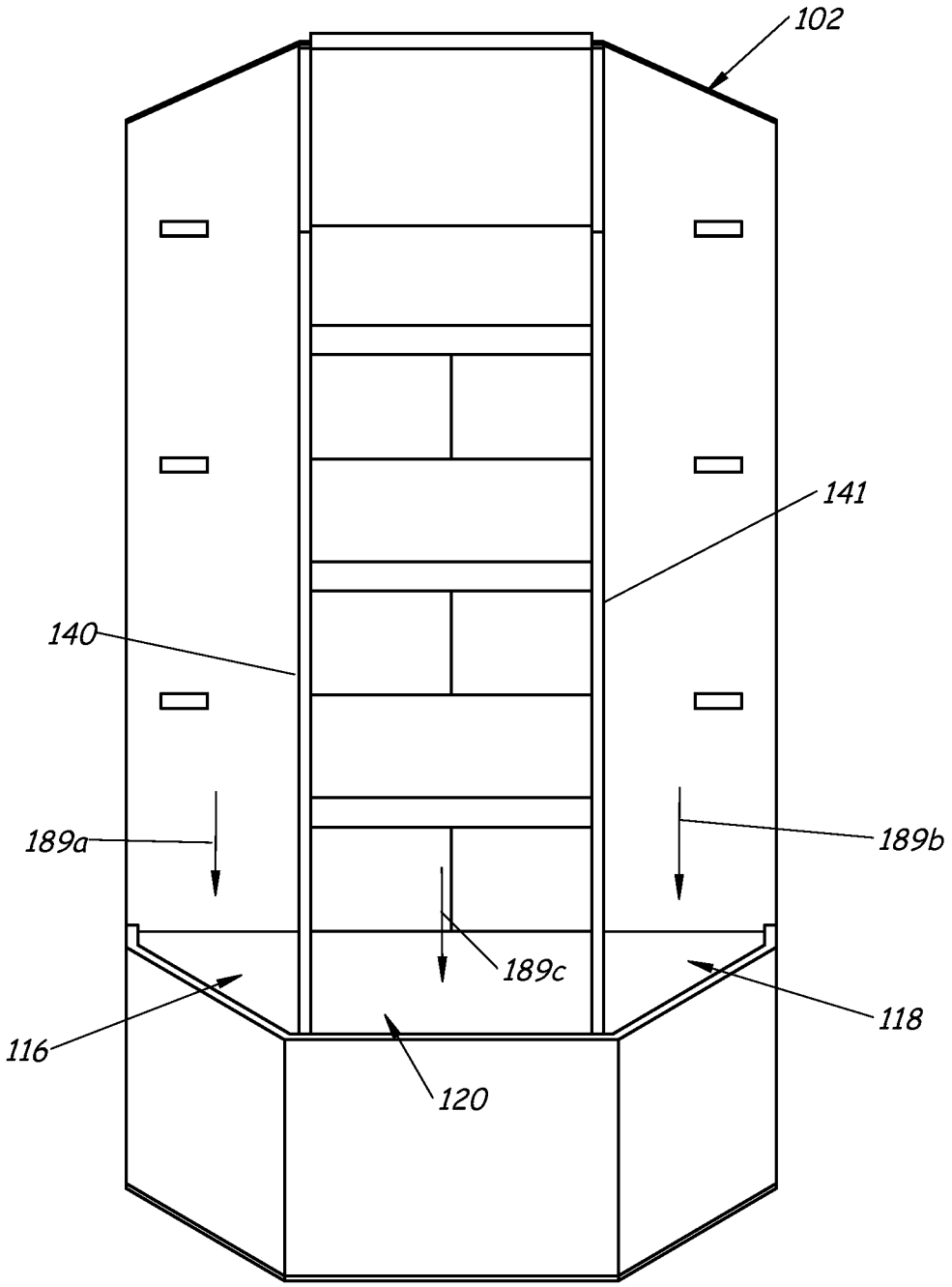
FIG. 25 is a front perspective view of the left bottom shelf in FIG. 13, the right bottom shelf in FIG. 14 and the center bottom shelf in FIG. 15 assembled to the assembly illustrated in FIG. 24.

FIG. 25 is a front perspective view of left bottom shelf 116 (FIG. 13), right bottom shelf 118 (FIG. 14) and center bottom shelf 120 (FIG. 15) assembled to the assembly illustrated in FIG. 24. Each of left bottom shelf 116, right bottom shelf 118 and center bottom shelf 120 include scores that define multiple different flaps. As illustrated in FIGS. 13-15, left and right bottom shelves 116 and 118 include five flaps and center bottom shelf 120 includes four flaps. Each flap on left bottom shelf 116, right bottom shelf 118 and center bottom shelf 120 is folded at its score and adhesive backings 117, 119 and 121, which are each located on one of the flaps of left bottom shelf 116, right bottom shelf 118 and center bottom shelf 120, respectfully, are removed.

To assemble left bottom shelf 116, the five flaps of left bottom shelf 116 are inserted into the assembly in a direction as indicated by arrow 189*a* until the bottom surface of the shelf body of left bottom shelf 116 is in contact with top edges of left bottom partition 188*a* and pressure is applied to secure the adhesive uncovered from removing adhesive backing 117 to the interior surface of bottom wrap 112. To assemble right bottom shelf 118, the five flaps of right bottom shelf 116 are inserted into the assembly in a direction as indicated by arrow 189*b* until the bottom surface of the shelf body of right bottom shelf 118 is in contact with top edges of right bottom partition 188*b* and pressure is applied to secure the adhesive uncovered from removing adhesive backing 119 to the interior surface of bottom wrap 112. To assemble center bottom shelf 120, the four flaps of center bottom shelf 120 are inserted into the assembly in a direction as indicated by arrow 189*c* until the bottom surface of the shelf body of center bottom shelf 120 is in contact with top edges of center bottom partition 188*c* and pressure is applied to secure the adhesive uncovered from removing adhesive backing 121 to the interior surface of bottom wrap 112.

With reference back to FIGS. 1-5, where portion 100 of a display fixture is fully assembled, a plurality of left corner shelves 124 of which one is shown in a plan view in FIG. 17, a plurality of right corner shelves 126 of which one is shown in a plan view in FIG. 18, a plurality of center shelves 122 of which one is shown in a plan view in FIG. 16, a sign holder 128 as shown in FIG. 19 and a plurality of transparent plastic fronts 190 are assembled to the assembly illustrated in FIG. 25. Transparent plastic fronts 190 prevent merchandise from falling off shelves 122, 124 and 126. As illustrated in FIGS. 17 and 18, each left shelf 124 and each right shelf 126 is already shipped to a retail store in an erected configuration, while each center shelf 122 is shipped to a retail store in a substantially planar configuration and includes scores that define multiple different flaps for assembling onto each center shelf insert 108. As illustrated in FIGS. 1-5, left body 104 is attached to the front side of main body 102 and right body 106 is attached to the front side of main body 102 so that left body 104 and right body 106 divide the plurality of shelves on the front of portion 100 into left corner shelves 124, center shelves 122 and right corner shelves 126.

To assemble each center shelf 122 onto each center shelf insert 108, back flap 122*a*, back side flaps 122*b* and 122*c* and front side flaps 122*d* and 122*e* of each center shelf 122, of which one is illustrated in FIG. 16, are folded along their score lines and placed over each center shelf insert 108. Back flap 122*a* is pressed down and inserted between top center shelf insert 108 and main body 102. Back side flaps 122*b* and 122*c* and front side flaps 122*d* and 122*e* are pressed down and inserted between top shelf insert 108 and side panel 140 of left body 104 and side panel 141 of right body 106. Further, the dog eared ends of front side flaps 122*d* and 122*e* are folded inwards. Lastly, front flap 122*f* is folded down, over front side flaps 122*d* and 122*e* and lock tabs on front flap 122*f* are inserted between center shelf insert 108 and center shelf 122. These steps are repeated for each center shelf 122 that is to be assembled to each shelf insert 108 including a top shelf insert 108, a middle shelf insert 108 and a bottom shelf insert 108.

To assemble each left shelf 124 to main body 102 and side panel 140 of left body 104 and each right shelf 126 to main body 102 and side panel 141 of right body 106, shelf supports are inserted into the slots 102*a*, 102*b*, 102*c*, 102*d*, 102*e* and 102*f* (FIGS. 20 and 21) located on the front side of main body 102. Each left shelf 124 and each right shelf 126 is secured to main body 102 and side panel 140 of left body 104 and side panel 141 of right body 106 by sliding slots on each shelf 124 and 126 into each shelf support and applying pressure to adhesive areas on each shelf 124 and 126 onto main body 102 and left and right bodies 104 and 106. For further support, clips are used to secure the corner of each shelf that abuts main body 102 and side panel 140 of left body 104 or side panel 141 of right body 106.

To assemble sign holder 128 to main body 102, flaps 128*a* and 128*b* are folded at their score lines. Flap 128*a* is inserted between back support 114 and main body 102 and flap 128*b* is pressed down flush against straight segment 136 of top free edge 133 and top ends of back panels 138 and 129 of left and right bodies 104 and 106. An adhesive strip located on the backside of sign holder 128 is adhered to top panels 142 and 143 of left and right bodies 104 and 106. Different transparent sign pockets can be attached to sign holder 128 for displaying signage. For example, back tabs of a 7×11 inch transparent sign pocket may be placed into slots in sign holder 128 and the 7×11 transparent sign pocket can receive a 7×11 sign.

To assemble transparent plastic fronts 190, holes at the ends of transparent plastic fronts 190 are aligned with holes on main body 102, holes on left body 104 and holes on right body 106. More specifically, holes in left fronts 190 are aligned with holes in main body 102 and holes in side panel 140 of left body 104. Holes in right fronts 190 are aligned with holes in main body 102 and holes in side panel 141 of right body 106. Holes in center fronts 190 are aligned with holes in side panel 149 of left body 104 and side panel 141 of right body 104. After hole alignment, lock screws are inserted through the holes to attach plastic fronts 190 to portion 100 of the display fixture.

Figure 26:
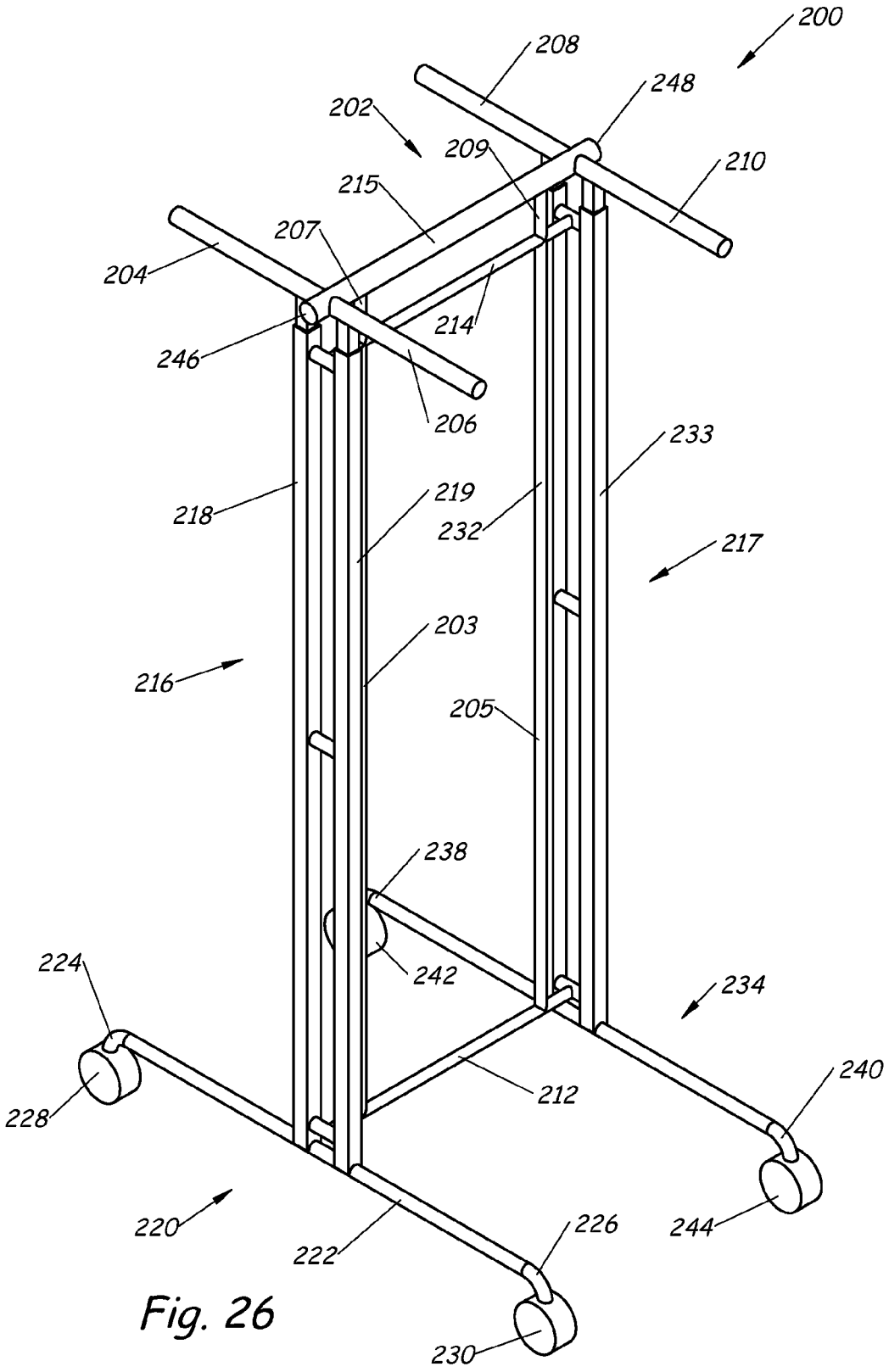
FIG. 26 is a perspective view of a permanent portion of the cross-merchandising display fixture.

FIG. 26 is a perspective view of a permanent portion or rack display 200 of a cross-merchandising display fixture. In one embodiment, portion 200 is a quad rack fixture. Portion 200 of the cross-merchandising display fixture is adapted for displaying merchandise, for example clothing maintained on hangers. More specifically, a quad rack fixture is one that includes a frame 202, a first extendable arm 204, a second extendable arm 206, a third extendable arm 208, and a fourth extendable arm 210. Each extendable arm 204, 206, 208 and 210 includes a substantially horizontal portion and a substantially vertical portion. The horizontal portions of the extendable arms are, in one embodiment, adapted for supporting or otherwise maintaining clothes, hangers, etc. The vertical portions of the extendable arms are, in one embodiment, telescopic.

Frame 202 includes, in one embodiment, first end pieces 216 and second end pieces 217, the first and second end pieces 216, 217 being adapted to support frame 202 on a retail store floor (not shown). Frame 202 further includes a lower cross member 212, an intermediate cross member 214, and a top cross member 215. Cross members 212, 214 and 215 connect first end pieces 216 to second end pieces 217. Further, lower cross member 212 is connected to intermediate cross member 214 by two substantially vertical frame members 203 and 205 and intermediate cross member 214 is connected to upper cross member 216 by two substantially vertical frame members 207 and 209. Together, first end pieces 216, second end pieces 217, lower cross member 212, intermediate cross member 214 and upper cross member 215 support portion 200 in an upright configuration.

In some embodiments, first end pieces 216 include a first substantially vertical receiving member 218, a second substantially vertical receiving member 219 and a lower wheel assembly 220 secured to a bottom of first substantially vertical receiving member 218 and second substantially vertical receiving member 219. First substantially vertical receiving member 218 receives the substantially vertical portion of first extendable arm 204 and second substantially vertical receiving member 219 telescopically receives the substantially vertical portion of second extendable arm 206. First and second substantially vertical receiving members 218 and 219 are, in one embodiment, substantially square in transverse cross-section. Lower wheel assembly 220 includes a substantially horizontal base member 222 having a first end 224, a second end 226, and wheels 228 and 230 mounted on each of the first and second ends 224 and 226, respectively.

In some embodiments, second end pieces 217 includes a third substantially vertical receiving member 232, a fourth substantially vertical receiving member 233 and a lower wheel assembly 234 secured to third substantially vertical receiving member 232 and fourth substantially vertical receiving member 233. Third substantially vertical receiving member 232 telescopically receives the substantially vertical portion of third extendable arm 208 and fourth substantially vertical receiving member telescopically receives the substantially vertical portion of fourth extendable arm 210. Third and fourth substantially vertical receiving members 232 and 233 are, in one embodiment, substantially square in transverse cross-section. Lower wheel assembly 234 includes a substantially horizontal base member 236 having a first end 238, a second end 240, and wheels 242 and 244 mounted on each of the first and second ends 238 and 240, respectively.

Upper cross member 215 is longer in length than intermediate cross member 214 and longer in length than lower cross member 212. In this way, opposing ends 246 and 248 of upper cross member 215 protrude outwardly from first end pieces 216 and second end pieces 217 as illustrated in FIG. 26.

Figure 27:
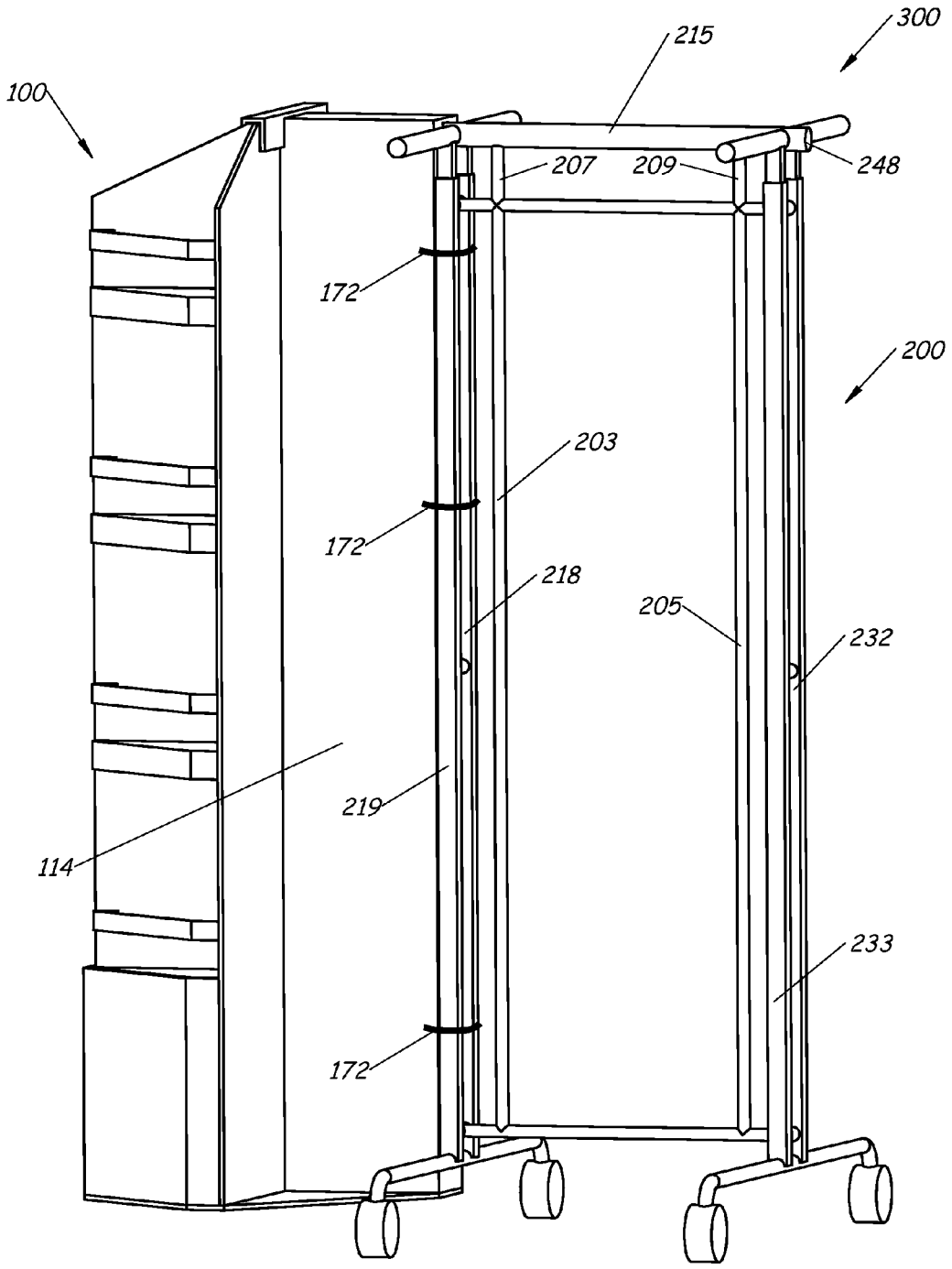
FIG. 27 is a perspective view of the temporary portion illustrated in FIG. 1 coupled to the permanent portion illustrated in FIG. 26 to form one embodiment of a cross-merchandising display fixture.

FIG. 27 is a perspective view of portion 100 coupled to permanent portion (or quad rack fixture) 200 to form one embodiment of a cross-merchandising display fixture 300. With reference back to the back view of portion 100 in FIG. 3, back panel 176 of back support 114 includes an aperture or through hole 192 that extends through the backside into the hollow interior of back support 114. To assemble portion 100 to portion 200, aperture or through hole 192 is adapted to receive one of the protruding ends 246 or 248 of upper cross member 215 of permanent portion or quad rack fixture 200 as illustrated in FIG. 27. To further form cross-merchandising display fixture 300, zip ties 172, which were assembled to back support 114, are wrapped and assembled around first substantially vertical receiving member 218, second substantially vertical receiving member 219, substantially vertical member 203 and substantially vertical member 207 if end 246 of upper cross member 215 is inserted into aperture 192. Alternatively, zip ties 172 are wrapped and assembled around third substantially vertical receiving member 232, fourth substantially vertical receiving member 233, substantially vertical member 205 and substantially vertical member 209 if end 248 of upper cross member 215 is inserted into aperture 192. As illustrated in FIG. 27, end 246 is inserted through aperture 192 and therefore upper zip tie 172 is wrapped around first and second substantially vertical receiving members 218 and 219 and substantially vertical member 207, intermediate zip tie 172 is wrapped around first and second substantially vertical receiving members 218 and 219 and substantially vertical member 203 and lower zip tie 172 is wrapped around first and second substantially vertical receiving members 218 and 219 and substantially vertical member 203. After wrapping and assembling zip ties 172, the zip ties are tightened.

As previously discussed, display fixture 300 is a cross-merchandising display fixture. In other words, merchandise that is displayed on shelves can be displayed on portion 100, while coordinating merchandise, such as clothing maintained on hangers, that is not normally displayed with the merchandise that is displayed on the shelves of portion 100 can be displayed together. For example, bottles of sun tanning lotion, sun blocking lotion, after-sun lotions, gels, sprays and the like can be displayed on portion 100, while bathing suits can be hung on hangers and displayed on permanent portion or quad rack fixture 200. Although such merchandise is not specifically illustrated in the figures, it should be realized that when bathing suits or other types of clothing are hung on hangers and displayed or hung from the substantially horizontal portions of extendable arms 204, 206, 208 and 210, back support 114 and zip ties 172 will be obscured by the merchandise and a seamless transition from bottles stocked on the shelves of portion 100 to clothing hung on permanent portion or quad rack fixture 200 is achieved.

Although the above describes portion 100 of cross-merchandising display fixture 300 as being temporary and components of portion 100 being made, in one embodiment, out of cardboard that is shipped to a retail store in a planar configuration, it should be realized that portion 100 can be made of more permanent materials and require a different type of assembly and set up that is not in planar configurations.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A display fixture comprising:

a permanent portion that supports merchandise and includes a frame having first end pieces, second end pieces and at least one cross member connecting the first end pieces to the second end pieces, wherein the first and second end pieces and the at least one cross member support the permanent portion in an upright configuration and wherein the at least one cross member includes a first end that protrudes outwardly from the first end pieces and a second end that protrudes outwardly from the second end pieces;

a temporary portion including a front that supports merchandise and a back that mates with the permanent portion; and a plurality of fasteners that attach the temporary portion to one of the first end pieces and the second end;

wherein the back of the temporary portion includes a back support that has a hollow interior and an aperture that receives one of the first end and the second end of the at least one cross member of the permanent portion.

2. The display fixture of claim 1, wherein the front of the temporary portion comprises a plurality of shelves that support merchandise.

3. The display fixture of claim 1, wherein the permanent portion comprises a plurality of extendable arms that support hanging merchandise.

4. The display fixture of claim 1, wherein the temporary portion comprises a plurality of components made of sheet material, the plurality of components being assembled together to form the temporary portion.

5. The display fixture of claim 1, wherein the temporary portion comprises a main body that divides the front of the temporary portion from the back of the temporary portion.

6. The display fixture of claim 1, wherein the aperture that receives one of the first end and the second end of the at least one cross member of the permanent portion extends through a back panel of the back support into the hollow interior of the back support.

7. A display fixture comprising:

a shelf display comprising:

a main body having a front side and a backside;

a plurality of shelves coupled to the front side of the main body and adapted to support merchandise;

a back support attached to the backside of the main body and extending from the backside of the main body;

a rack display comprising:

a frame having at least one substantially vertical member located on a first side of the rack display and at least one substantially vertical member located on a second side of the rack display;

at least one arm coupled to the frame to support hanging merchandise;

at least one cross member having a first end and a second end and coupling the at least one substantially vertical member on the first side of the rack display with the at least one substantially vertical member on the second side of the rack display, wherein the first end extends outwardly from the at least one substantially vertical member on the first side of the rack display and the second end extends outwardly from the at least one substantially vertical member on the second side of the rack display; and a plurality of fasteners that secure one of the at least one substantially vertical member located on the first side of the rack display and the at least one substantially vertical member located on the second side of the rack display to the back support of the shelf display;

wherein the back support includes a back panel having a through hole that receives one of the first end and the second end of the at least one cross member of the rack display.

8. The display fixture of claim 7, wherein the plurality of fasteners comprises a plurality of assembled zip ties that extend through side panels of the back support and wrap around one of the at least one substantially vertical member located on the first side of the rack display and the at least one substantially vertical member located on the second side of the rack display.

9. The display fixture of claim 7, wherein the at least one arm coupled to the frame to support hanging merchandise comprises a horizontal portion and a vertical portion, wherein the horizontal portion receives hanging merchandise and the vertical portion telescopically engages with a substantially vertical receiving member.

10. The display fixture of claim 7, wherein the shelf display further comprises a left body attached to the front side of the main body and a right body attached to the front side of the main body, the left body and right body dividing the plurality of shelves into left corner shelves, center shelves and right corner shelves.

11. The display fixture of claim 10, wherein each of the left corner shelves, the center shelves and the right corner shelves comprise transparent fronts that prevent merchandise from falling off the shelves.

12. A method of assembling a display fixture, the method comprising:

obtaining a rack display made of metal that includes a frame comprising:

at least one substantially vertical member located on a first side of the rack display and at least one substantially vertical member located on a second side of the rack display;

at least one arm coupled to the frame to support hanging merchandise;

at least one cross member having a first end that protrudes outwardly from the at least one substantially vertical member located on the first side of the rack display and a second end that protrudes outwardly from the at least one substantially vertical member on the second side of the rack display;

erecting a shelf display made of sheet material that includes a front having a plurality of shelves that support merchandise and a back having a back support;

inserting one of the first end of the at least one cross member and the second end of the at least one cross member through an aperture located in a back panel of the back support of the shelf display; and fastening the back support of the shelf display to one of the at least one substantially vertical member located on the first side of the rack display and the at least one substantially vertical member located on the second side of the rack display with a plurality of fasteners.

13. The method of claim 12, wherein the plurality of fasteners comprise a plurality of zip ties that are inserted through the back support of the shelf display and are wrapped around one of the at least one substantially vertical member located on the first side of the rack display and the at least one substantially vertical member located on the second side of the rack display.

* * * * *